US011796177B2

(12) United States Patent
Bogazzi

(10) Patent No.: US 11,796,177 B2
(45) Date of Patent: Oct. 24, 2023

(54) CHIMNEY VENT CAP

(71) Applicant: Marco Bogazzi, Marietta, GA (US)

(72) Inventor: Marco Bogazzi, Marietta, GA (US)

(73) Assignee: THE BIG GREEN EGG, INC., Atlanta, GA (US)

( * ) Notice: Subject to any disclaimer, the term of this patent is extended or adjusted under 35 U.S.C. 154(b) by 276 days.

(21) Appl. No.: 15/194,212

(22) Filed: Jun. 27, 2016

(65) Prior Publication Data

US 2017/0370592 A1 Dec. 28, 2017

(51) Int. Cl.
*F24B 1/02* (2006.01)

(52) U.S. Cl.
CPC ..... *F24B 1/028* (2013.01)

(58) Field of Classification Search
CPC ..... F24B 1/028
See application file for complete search history.

(56) References Cited

U.S. PATENT DOCUMENTS

| | | | | |
|---|---|---|---|---|
| D105,256 | S | 7/1937 | Amrine | |
| D135,161 | S | 3/1943 | Stempel | |
| D185,648 | S | 7/1959 | Rudebeck | |
| D191,838 | S | 11/1961 | Ebstein | |
| 3,276,440 | A * | 10/1966 | Sazegar | A47J 37/0704 126/25 A |
| 3,300,075 | A | 1/1967 | Dahl | |
| D289,614 | S | 5/1987 | Sanchez et al. | |
| 5,016,607 | A | 5/1991 | Doolittle et al. | |
| D336,817 | S | 6/1993 | Wilcox, Jr. | |
| D341,320 | S | 11/1993 | Morin | |
| D359,451 | S | 6/1995 | Dees | |
| D419,373 | S | 1/2000 | Geelen | |
| D472,145 | S | 3/2003 | Nottingham et al. | |
| 6,715,315 | B1 * | 4/2004 | Hartgrove | A44C 9/003 63/29.1 |

(Continued)

FOREIGN PATENT DOCUMENTS

| | | | | |
|---|---|---|---|---|
| GB | 2316601 A | * | 3/1998 | A47J 37/101 |
| GB | 2489392 A | | 10/2012 | |

OTHER PUBLICATIONS

Notice of Allowance dated Feb. 2, 2018, in co-pending Design U.S. Appl. No. 29/569,393, (5 pages).

(Continued)

*Primary Examiner* — Jason Lau
(74) *Attorney, Agent, or Firm* — Merchant & Gould P.C.

(57) ABSTRACT

The present disclosure describes a chimney vent cap for controlling the flow of exhaust gases exiting a vent stack or chimney of a grill, cooker, smoker, or other device. The chimney vent cap is adapted to receive and reside about the vent stack or chimney and is configurable in multiple configurations using single plane movement and absent insertion of a user's hand into the exhaust gases, with each configuration corresponding to a particular flow rate of exhaust gases through the chimney vent cap and, hence, through the vent stack or chimney. The chimney vent cap is adapted to retain such configuration absent user intervention during movement of the vent stack or chimney caused by opening and closing of the lid or top of such grill, cooker, smoker, or other device, such that the flow rate of exhaust gases after such movement is substantially the same as prior to such movement.

20 Claims, 22 Drawing Sheets

(56) References Cited

U.S. PATENT DOCUMENTS

| | | | | |
|---|---|---|---|---|
| D496,823 | S | 10/2004 | Josancy | |
| D533,396 | S | 12/2006 | Lipson | |
| 7,172,101 | B2 * | 2/2007 | Find | A47J 41/0005 220/230 |
| 7,337,497 | B2 * | 3/2008 | Seidler | A45D 40/24 16/320 |
| D578,391 | S | 10/2008 | Larkin et al. | |
| D627,639 | S | 11/2010 | Ziegler et al. | |
| D634,156 | S | 3/2011 | Fuller | |
| D651,458 | S | 1/2012 | Segers | |
| D668,104 | S | 10/2012 | Segers | |
| D689,738 | S * | 9/2013 | Hobbs | D7/402 |
| D696,068 | S | 12/2013 | Baacke et al. | |
| D701,421 | S | 3/2014 | Tai | |
| D701,422 | S | 3/2014 | Tai | |
| D703,998 | S | 5/2014 | Funnell, II et al. | |
| D722,815 | S | 2/2015 | Fuller | |
| D747,620 | S | 1/2016 | Chung | |
| D747,909 | S | 1/2016 | Simms, II | |
| D772,002 | S | 11/2016 | Affatato | |
| D817,090 | S | 5/2018 | Bogazzi | |
| 2007/0028780 | A1 | 2/2007 | Popeil et al. | |
| 2007/0047166 | A1 | 3/2007 | Creel et al. | |
| 2008/0230045 | A1 * | 9/2008 | Bruno | A47J 37/0704 126/25 R |
| 2011/0283990 | A1 * | 11/2011 | Walters | A47J 37/0704 126/25 R |
| 2016/0135645 | A1 | 5/2016 | Walters | |
| 2016/0174767 | A1 * | 6/2016 | Schlosser | A47J 37/0704 126/25 R |
| 2016/0220066 | A1 | 8/2016 | Roberts | |
| 2016/0255998 | A1 | 9/2016 | Feng | |

OTHER PUBLICATIONS

International Search Report and Written Opinion for International Application No. PCT/US2017/039519 dated Sep. 11, 2017; 7 pgs.
Copending Design U.S. Appl. No. 29/569,393, filed Jun. 27, 2016 by Marco Bogazzi, entitled "Chimney Vent Cap".

* cited by examiner

CHIMNEY VENT CAP

FIELD OF THE INVENTION

The present invention relates, generally, to the field of devices having chimneys through which exhaust gases exit and, more particularly, to apparatuses and methods for controlling the flow of exhaust gases exiting grills, cookers, smokers, and other devices for food preparation.

BACKGROUND OF THE INVENTION

The temperature within grills, cookers, smokers, and other devices used to prepare food is often controlled by adjustment of the amount of air flowing into the grill, cooker, smoker, or other device in relation to the amount of fuel available for combustion. Traditionally, grills, cookers, smokers, or other devices have permitted such adjustment via air inlet openings configured with user-adjustable dampers. Some grills, cookers, smokers, and other devices have also permitted such adjustment via exhaust outlet openings that are similarly configured with user-adjustable dampers. Through user adjustment of the air inlet dampers and exhaust outlet dampers, alone or in combination, more or less air is permitted to enter and more or less exhaust gases are permitted to exit with the result being that the fuel combustion rate and, hence, the temperature within the grill, cooker, smoker, or other device is increased or decreased as desired by the user.

In some grills, cookers, and smokers, such as Kamado-style cookers, air generally enters through an air inlet opening having a user-adjustable damper that is located near the device's lowermost portion or base. After entering, the air oxidizes fuel present in a combustion zone, causing hot exhaust gases to be produced. The hot exhaust gases pass upward through the grill, cooker, smoker, or other device and transfer a portion of their heat to the food being prepared and/or to the walls and other components of the device. The hot exhaust gases continue to pass upward and through a vent stack or chimney, located at or near the highest location of the device's uppermost portion or lid, before exiting the device into the surrounding environment.

Many Kamado-style cookers are fitted with a daisy wheel damper atop the vent stack or chimney to permit users to control the flow of exhaust gases attempting to exit via the vent stack or chimney. Unfortunately, some daisy wheel dampers require users to place their hands within the hot exhaust gas stream exiting the cooker in order to adjust the dampers, thereby exposing the users to the possibility of burns from exposure to hot exhaust gases. Other daisy wheel dampers may change position when cooker lids are opened or closed, requiring users to reset the dampers' positions in order to obtain a desired flow of hot exhaust gases through the cookers and desired temperatures within the cookers. Still other daisy wheel dampers are leaky and may allow rain water or other liquid to enter a cooker, even if configured in a "closed" position in anticipation of possible rainfall or exposure to liquids.

There is, therefore, a need in the industry for a user-adjustable device for controlling the exit of exhaust gases from (and, hence, the draft through) a grill, cooker, smoker, or other device that solves these and other problems, deficiencies, and shortcomings of present devices.

SUMMARY OF THE INVENTION

Broadly described, the present invention comprises apparatuses and methods for controlling the flow of exhaust gases exiting a vent stack or chimney of a grill, cooker, smoker, or other device. In one inventive aspect and according to an example embodiment, a chimney vent cap is adapted to maintain its configuration when a lid or top of the grill, cooker, smoker, or other device is opened, closed, or moved into another position such that the flow of exhaust gases exiting a vent stack or chimney to which the chimney vent cap is secured remains substantially the same as before the lid or top was opened, closed, or moved into another position. In another inventive aspect and according to an example embodiment, the chimney vent cap is configurable in a plurality of configurations to adjust the flow of exhaust gases exiting a vent stack or chimney to which the chimney vent cap is secured and to do so without a user inserting the user's hand or fingers into the flow of exhaust gases. In still another inventive aspect and according to an example embodiment, the chimney vent cap is operable in a single plane to control or adjust the flow of exhaust gases exiting a grill, cooker, smoker, or other device. In yet another inventive aspect and according to an example embodiment, the chimney vent cap is operable to control or adjust the flow of exhaust gases exiting a grill, cooker, smoker, or other device without substantially redirecting the flow of exhaust gases from a predominant direction of travel prior to encountering the chimney vent cap. In yet another inventive aspect and according to an example embodiment, the chimney vent cap is configured to direct liquid (such as, but not limited to, rain water) away from a vent stack or chimney of a grill, cooker, smoker, or other device with which the chimney vent cap is used and substantially prevent such liquid from entering the vent stack or chimney.

Other inventive aspects, advantages and benefits of the present invention may become apparent upon reading and understanding the present specification when taken in conjunction with the appended drawings.

DETAILED DESCRIPTION OF THE DRAWINGS

Figure 1:
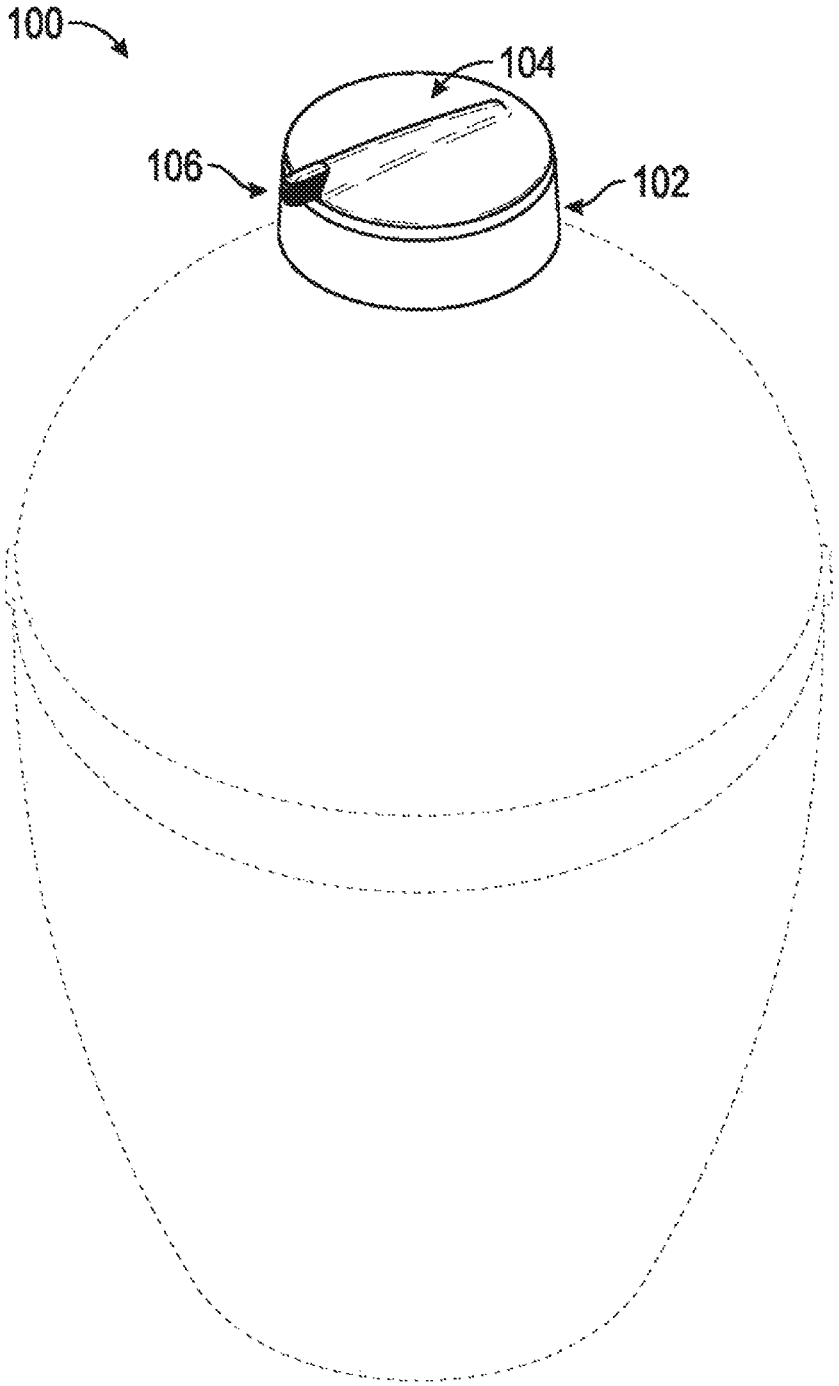
FIG. 1 displays a perspective view of a chimney vent cap, in accordance with a first example embodiment of the present invention, in use atop a cooking device and configured in a fully-closed, first configuration.

Referring now to the drawings in which like numerals represent similar elements or steps throughout the several views, FIG. 1 displays a perspective view of a chimney vent cap 100 in accordance with an example embodiment of the present invention. The chimney vent cap 100 is, as illustrated in FIG. 1, adapted to reside atop and about a chimney of a grill, cooker (such as, but not limited to, a Kamado-style cooker shown in broken lines in FIG. 1), smoker, or other device having a chimney (such as, but not limited to, a chiminea) and to receive at least a portion of the chimney therein. When so positioned or oriented relative to a chimney, exhaust gases flowing through the chimney (including, without limitation, by-product gases from the combustion of fuel occurring within or in connection with the grill, cooker, smoker or other device and other entrained gases not resulting from the combustion of fuel) are directed to the chimney vent cap 100 which, based on its then current user-selectable configuration, (a) maximally, or entirely, blocks the flow of exhaust gases attempting to pass through and exit the chimney and chimney vent cap 100, (b) minimally blocks the flow of exhaust gases attempting to pass through and exit the chimney and chimney vent cap 100, or (c) partially blocks the flow of exhaust gases attempting to pass through and exit the chimney and chimney vent cap 100. By increasingly or decreasingly blocking the flow of the exhaust gases, the chimney vent cap 100 respectively creates more or less backpressure within the grill, cooker, smoker, chiminea, or other device (each being sometimes referred to herein, individually, with the term "cooking device") and correspondingly decreases or increases the draft through and the flow of fresh air into the cooking device via an air inlet located elsewhere in the cooking device. By decreasing the amount of fresh air entering and available for combustion, the temperature within the cooking device is decreased. Conversely, by increasing the amount of fresh air entering and available for combustion, the temperature within the cooking device is increased. Thus, by controlling the flow of exhaust gases attempting to pass through and exit the chimney and chimney vent cap 100, the chimney vent cap 100 at least partially controls the temperature within the cooking device.

Figure 2:
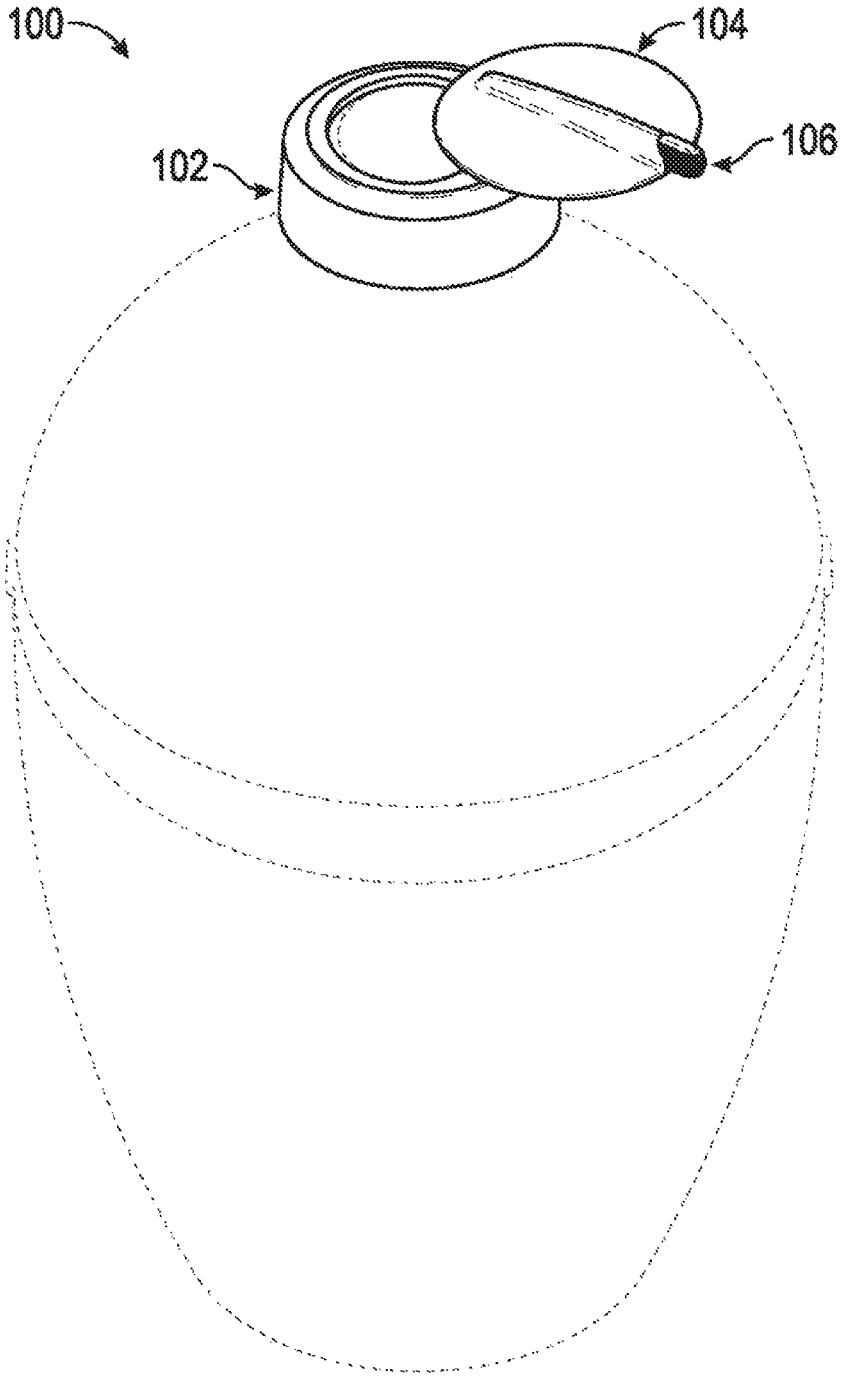
FIG. 2 displays a perspective view of the chimney vent cap of FIG. 1 in use atop the cooking device and configured in a fully-open, second configuration.
Figure 3:
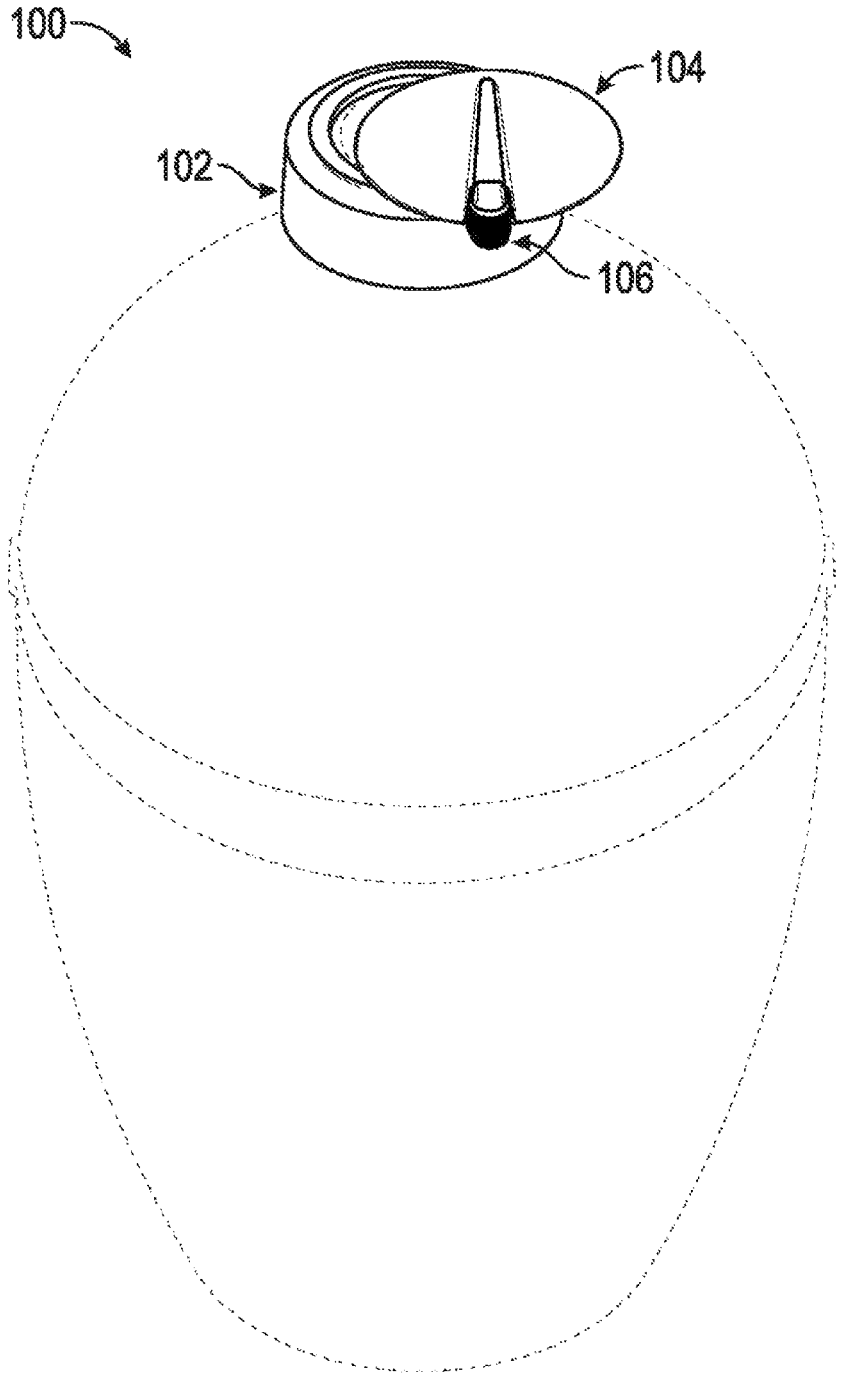
FIG. 3 displays a perspective view of the chimney vent cap of FIG. 1 in use atop the cooking device and configured in an intermediate, partially-open, third configuration.
Figure 4:
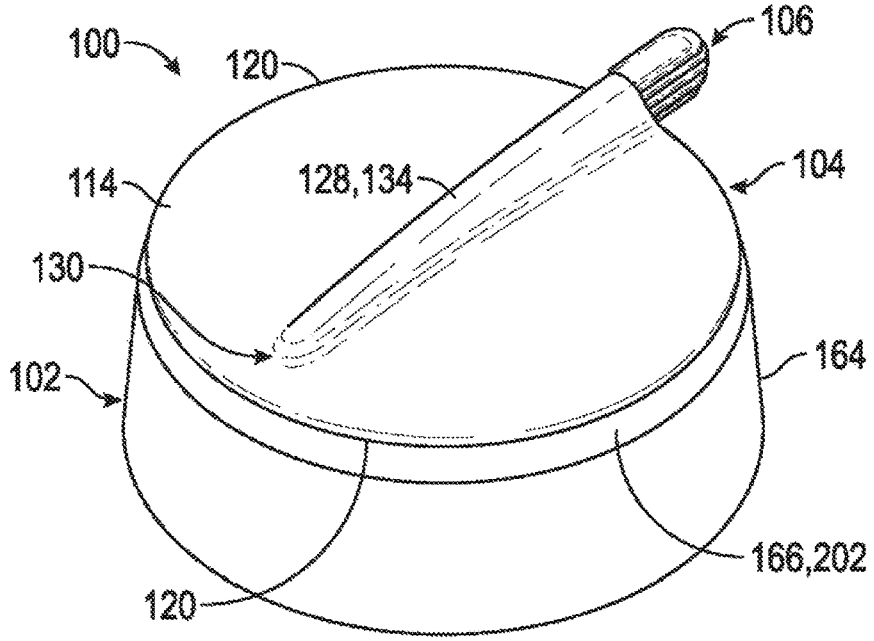
FIG. 4 displays a perspective view of the chimney vent cap of FIG. 1 in the fully-closed, first configuration.
Figure 5:
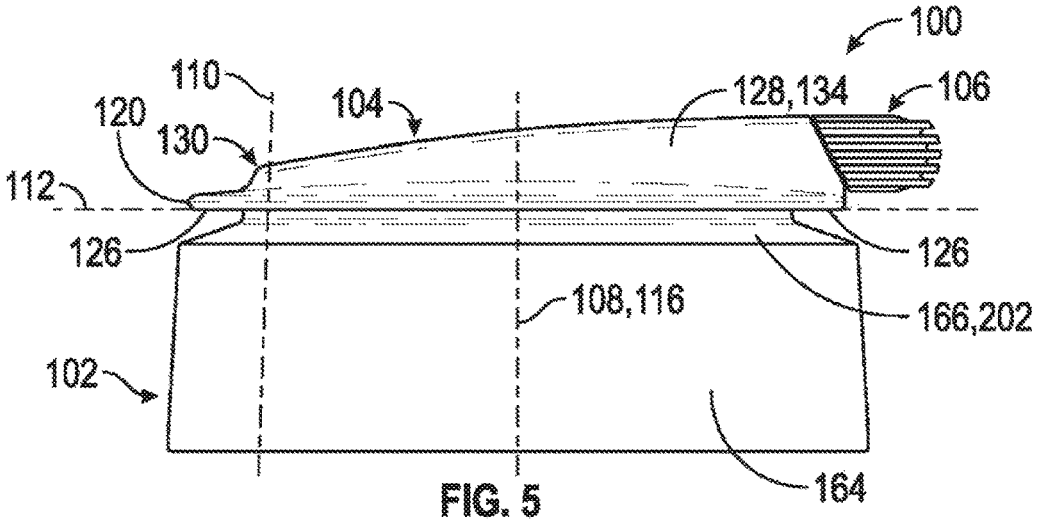
FIG. 5 displays a front elevation view of the chimney vent cap of FIG. 4.
Figure 6:
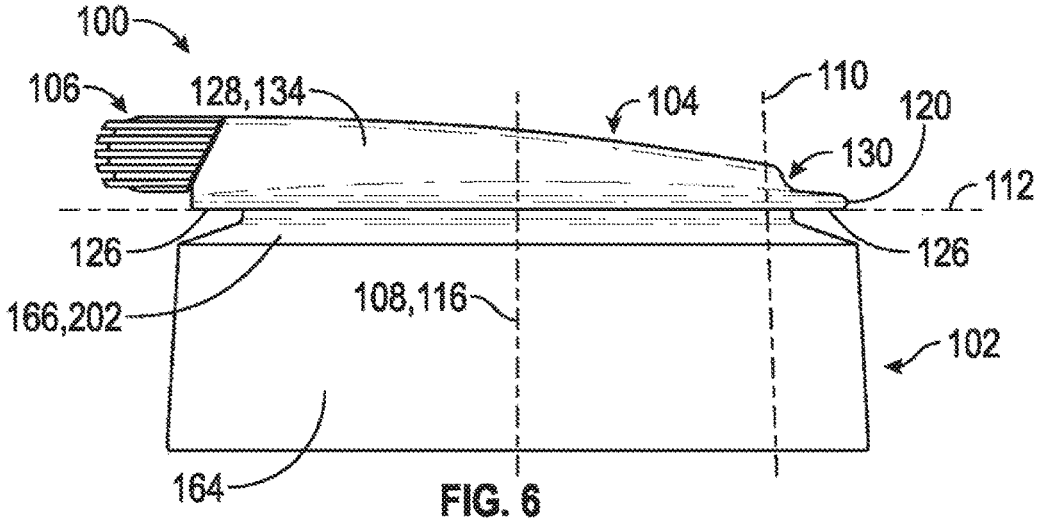
FIG. 6 displays a back elevation view of the chimney vent cap of FIG. 4.
Figure 7:
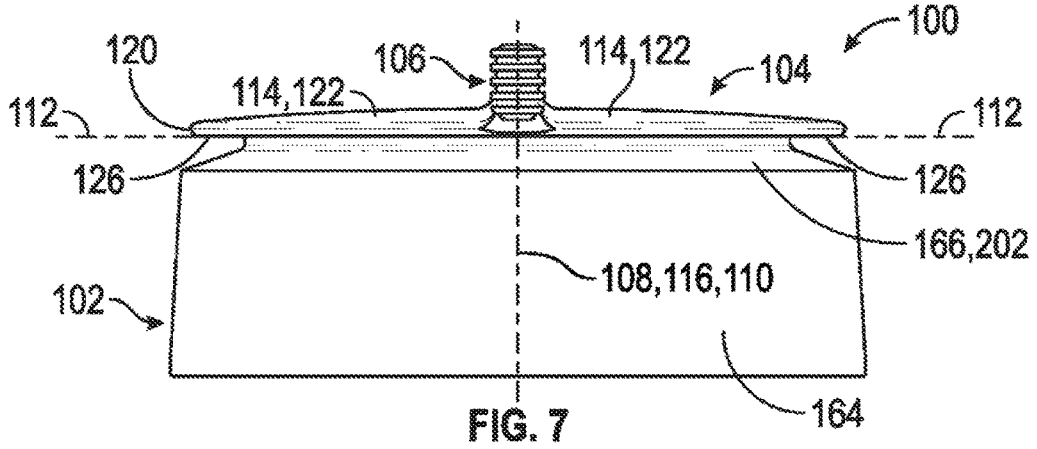
FIG. 7 displays a right side elevation view of the chimney vent cap of FIG. 4.
Figure 8:
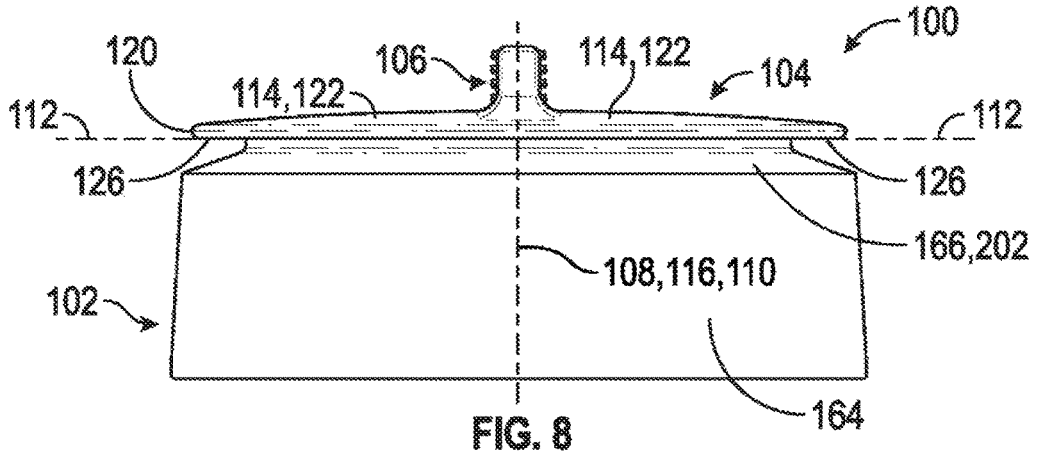
FIG. 8 displays a left side elevation view of the chimney vent cap of FIG. 4.
Figure 9:
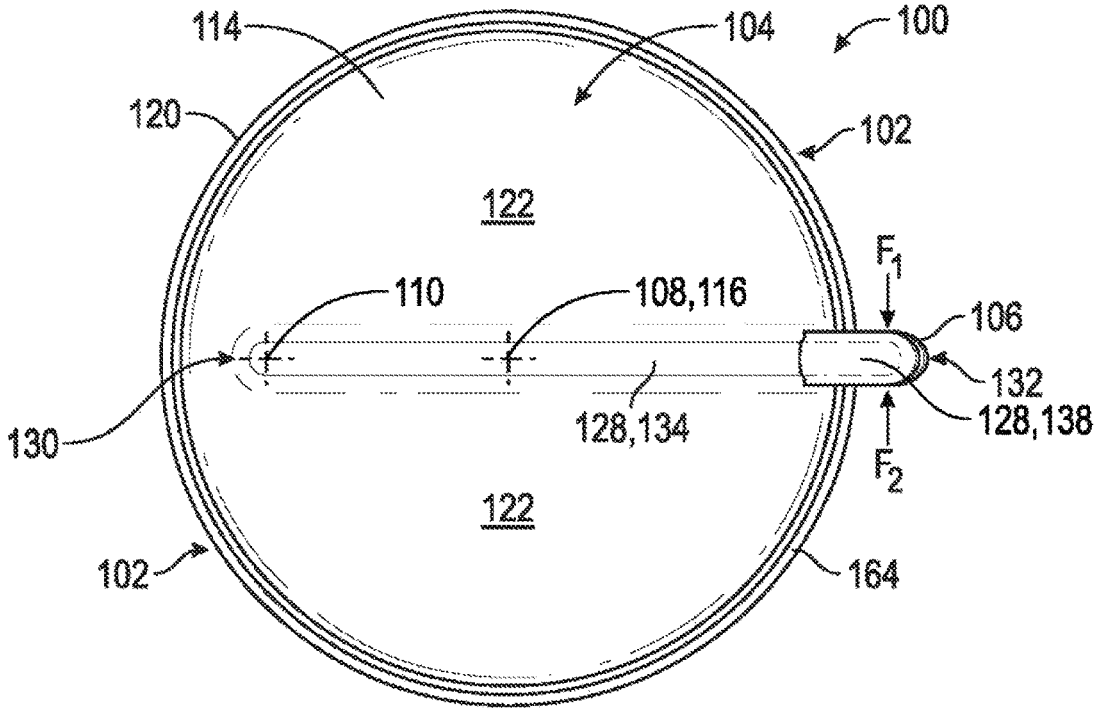
FIG. 9 displays a top plan view of the chimney vent cap of FIG. 4.
Figure 10:
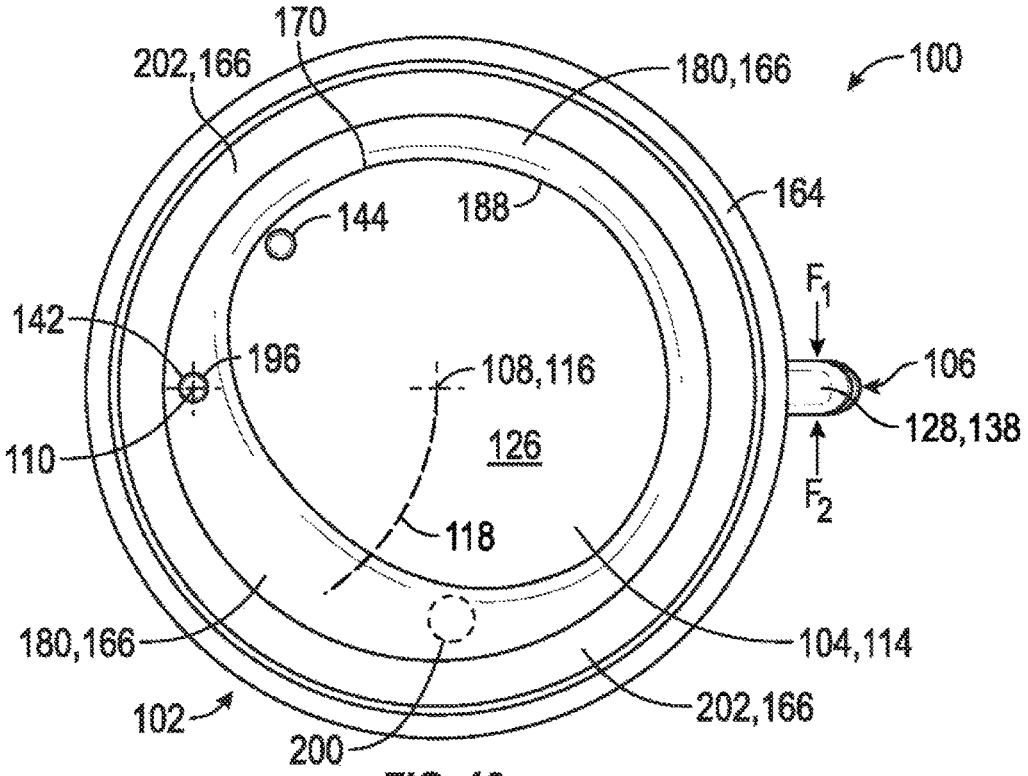
FIG. 10 displays a bottom plan view of the chimney vent cap of FIG. 4.

The chimney vent cap 100, in accordance with a first example embodiment, comprises a base member 102, a control member 104, and a grip member 106. The base member 102 and control member 104 are pivotally connected for rotation therebetween to enable the control member 104 to be pivotally configured relative to the base member 102, as desired by a user, to cause the chimney vent cap 100 to minimally, maximally, or partially block and control the flow of the exhaust gases attempting to pass through and exit the chimney vent cap 100, and to at least partially control the temperature inside the cooking device with which the chimney vent cap 100 is used. The grip member 106 is connected to the control member 104 and may be grasped by a user to impart a force to the grip member 106 and control member 104 (by virtue of the grip members' connection to control member 104) causing the control member 104 to pivot relative to the base member 102 and place the chimney vent cap 100 in a fully-closed, first configuration (see FIG. 1), in a fully-open, second configuration (see FIG. 2), or in one of a plurality of intermediate, partially-open, third configurations (see FIG. 3) in which the control member 104 is positioned at an angular location between the control member's angular location in the fully-closed, first configuration and the fully-open, second configuration. In the fully-closed, first configuration, the chimney vent cap 100 maximally (or entirely) blocks the flow of exhaust gases and prevents the entire flow of exhaust gases from passing through and exiting the chimney vent cap 100 into the surrounding environment. In the fully-open, second configuration, the chimney vent cap 100 minimally blocks the flow of exhaust gases and allows a maximum flow of the exhaust gases to pass through and exit the chimney vent cap 100 into the surrounding environment. In the intermediate, partially-open, third configuration, the chimney vent cap 100 partially blocks the flow of exhaust gases and allows part of the flow of exhaust gases to pass through and exit the chimney vent cap 100 into the surrounding environment.

Figure 11:
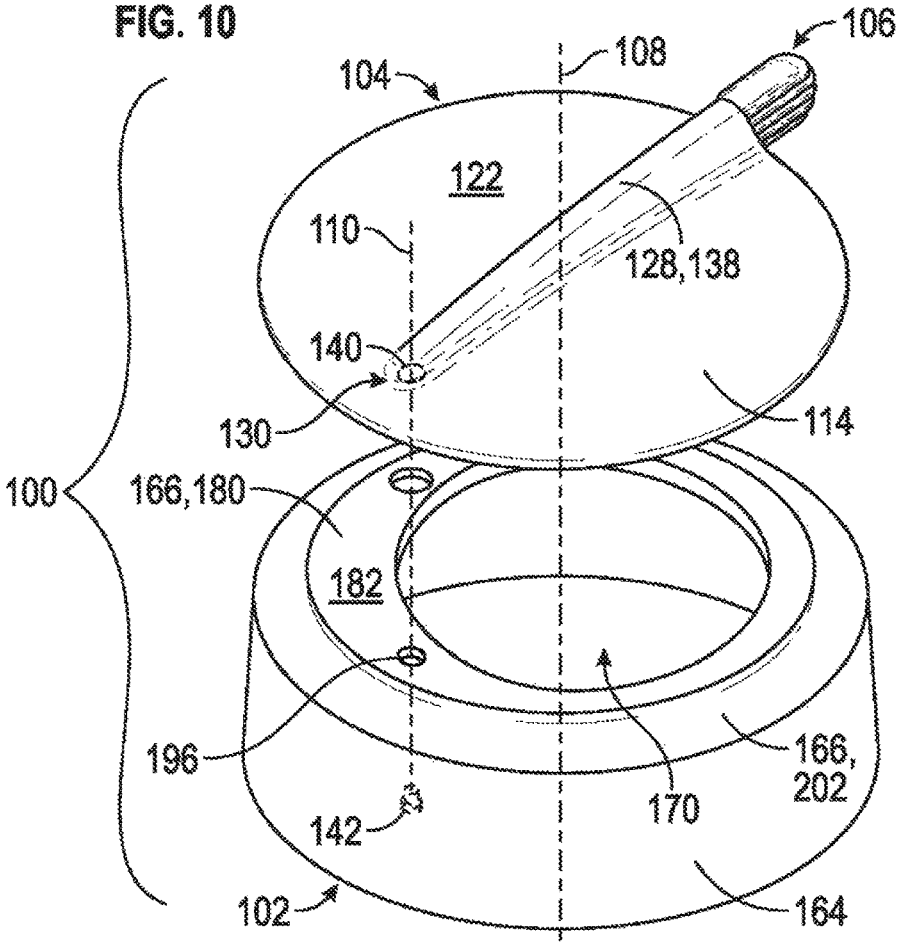
FIG. 11 displays an exploded view of the chimney vent cap of FIG. 4.
Figure 12:
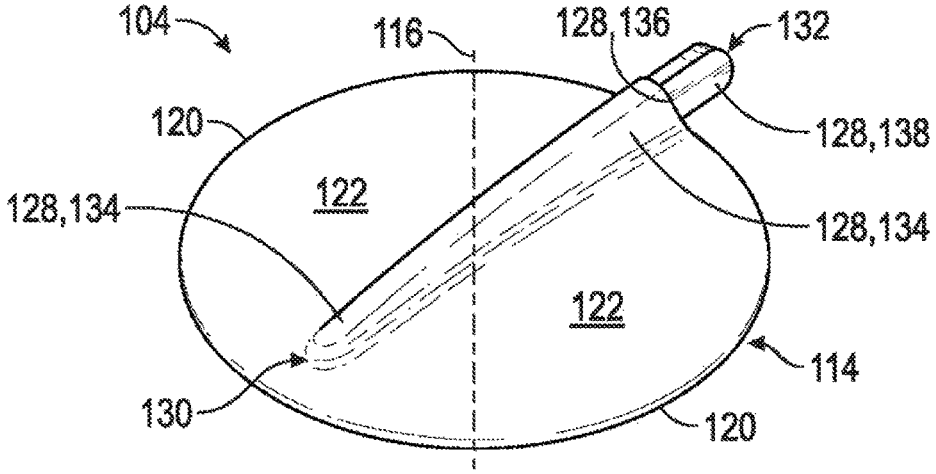
FIG. 12 displays a perspective view of a control member of the chimney vent cap of FIG. 1.

The chimney vent cap 100 is illustrated more clearly in the fully-closed, first configuration in the perspective and orthogonal views of FIGS. 4-10 and in the exploded view of FIG. 11. As seen in the top and bottom plan views, the base and control members 102, 104 each have a generally circular, plan view shape with the grip member 106 extending outside the base and control members' circular peripheries. The base member 102 defines a central longitudinal axis 108 extending therethrough such that when the chimney vent cap 100 is installed atop and about the chimney of a cooking device, the central longitudinal axis 108 is generally collinear with a central longitudinal axis of the chimney. The control member 104 sits on top of and in contact with the base member 102 and, together, the control member 104 and base member 102 define a rotational axis 110 extending generally parallel to and offset laterally and eccentrically from central longitudinal axis 108. The control member 104 is eccentrically rotatable about rotational axis 110 relative to the base member 102 to permit the control member 104 and base member 102 to be moved between and configured in their relative positions in the fully-closed, first configuration, in the fully-open, second configuration, or in an intermediate, partially-open, third configuration.

The control member 104 and base member 102 (and, more particularly, the disc portion's planar bottom surface 126 and base member's planar bearing surface 182) also define a plane 112 extending laterally therebetween that is substantially perpendicular to the central longitudinal axis 108 and rotational axis 110 and through which all exhaust gases must pass when exiting the chimney vent cap 100 into the surrounding environment. During rotation of the control member 104 about rotational axis 110, the control member 104 slides on, in contact with, and relative to base member 102 such that the disc portion's planar bottom surface 126 moves in a single plane parallel to plane 112 and the base member's planar bearing surface 182. And, for that matter, all other portions of the control member 104 also correspondingly move in a respective plane parallel to plane 112 and, hence, parallel to respective portions of the base member 102. At least because the bottom surface 126 of the control member 104 (and, more particularly, the bottom surface 126 of disc portion 114) moves within a single plane, the chimney vent cap 100 controls the flow of exhaust gases via movement in a single plane and with such single plane being substantially perpendicular to the predominant direction of flow of the exhaust gases. Advantageously, through use of such planar control, the chimney vent cap 100 controls the flow of exhaust gases from a cooking device without requiring the exhaust gases to substantially change their predominant direction of flow as occurs in other cooking device exhaust gas flow control devices. By requiring no substantial change in the predominant direction of flow, the unwanted influence on draft and temperature within a cooking device created by backpressure resulting from a change in the predominant direction of exhaust gas flow is avoided, thereby allowing the chimney vent cap 100 to provide more accurate and true control over draft and temperature within the cooking device as compared with exhaust gas flow control devices that cause a substantial change in the predominant direction of flow of exhaust gases.

The control member 104, seen isolated in the various views of FIGS. 12-18, includes a disc portion 114 that defines a central longitudinal axis 116 extending through the plan view center of the disc portion 114 which is substantially parallel to the base member's central longitudinal axis 108 and to rotational axis 110. When the chimney vent cap 100 is configured in the fully-closed, first configuration, the disc portion's central longitudinal axis 116 is collinear with the base member's central longitudinal axis 108. When the chimney vent cap 100 is configured in the fully-open, second configuration or in any intermediate, partially-open, third configuration, the disc portion's central longitudinal axis 116 remains parallel to the base member's central longitudinal axis 108 by virtue of the control member 104 moving only parallel to plane 112, but the disc portion's central longitudinal axis 116 is not collinear with the base member's central longitudinal axis 108. Instead, the disc portion's central longitudinal axis 116 is located at a respective position along an arc 118 (see FIG. 10) extending at a radius about rotational axis 110, resulting from rotation of the control member 104 relative to the base member 102 about rotational axis 110 and into the respective fully-open, second configuration or an intermediate, partially-open, third configuration.

The disc portion 114 of the control member 104 has an edge 120 at its periphery and a top surface 122 bounded by edge 120 that is highest in elevation near central longitudinal axis 116 and slopes gradually away from central longitudinal axis 116 and toward edge 120. The disc portion 114 is sized relative to the base member 102 such that the disc portion 114 fully occludes a second opening 170 (described below) of the base member 102 when the chimney vent cap 100 is configured in the fully-closed, first configuration. By fully occluding the second opening 170, the disc portion 114 fully blocks exhaust gases from passing through and exiting the chimney vent cap 100 and fully blocks rain or other liquid from entering the chimney vent cap 100 (and, hence, from entering a cooking device with which the chimney vent cap 100 is used) when the chimney vent cap 100 is configured in the fully-closed, first configuration.

The disc portion 114 is also sized relative to the base member 102 so that edge 120 and a circular groove 124 formed slightly inboard of edge 120 in the disc portion's generally planar bottom surface 126 (also sometimes referred to herein as the "control member's bottom surface 126"), both extend at least partially over a rain directing portion 202 (described below) of the base member's end wall 166 when the chimney vent cap 100 is configured in the fully-closed, first configuration (see FIGS. 4-8). Because the disc portion's top surface 122 slopes generally toward edge 120 and because edge 120 and groove 124 extend over the rain directing portion 202 of the base member's end wall 166 in such configuration, rain water or other liquid falling on or striking the control member 104 is directed to the disc portion's edge 120 and, typically, falls or drips from the edge 120 or groove 124 (the edge 120 and groove 124 together comprising a "drip edge") onto the rain directing portion 202 of the base member's end wall 166. The rain water or other liquid is then guided away from the base member's second opening 170 by the rain directing portion 202, thereby minimizing the possibility that rain water or other liquid falling on or striking the control member 104 may enter the chimney vent cap 100 and cooking device with which the chimney vent cap 100 is in use.

The control member 104 also includes a rib 128 that protrudes from the disc portion's top surface 122 and to which the grip member 106 connects. The rib 128 has a first end 130 located slightly inboard of the disc portion's edge 120 and extends substantially across the disc portion's top surface 122 in a generally diametric direction through the disc portion's plan view center to a distal second end 132 located slightly beyond or outboard of the disc portion's edge 120. The rib 128 has a first portion 134 that extends from the rib's first end 130 to a shoulder surface 136 located generally near the disc portion's edge 120, and has a second portion 138 that protrudes from the shoulder surface 136 to the rib's second end 132 and over which the grip member 106 resides as more fully described below. The shoulder surface 136 defines an angle, 0, with a vertical axis. Because the rib's second end 132 is slightly beyond and outboard of the disc portion's edge 120, a major portion of the grip member 106 is also positioned slightly outboard of the disc portion's edge 120. By virtue of the major portion of the grip member 106 being located slightly outboard of the disc portion's edge 120 and the eccentric rotation of the control member 104 (and, hence, the eccentric rotation of the grip member 106) about rotational axis 110 during movement of the control member 104 relative to the base member 102, a user's fingers will generally always be outside the disc portion's periphery and outside the base member's periphery when grasping the grip member 106 to rotate the control member 104 relative to the base member 102 (see FIGS. 4-6 and 9-11), thereby minimizing exposure of the user's fingers to hot exhaust gases exiting the base member's second opening 170 and making the chimney vent cap 100 safer to use.

Figure 13:
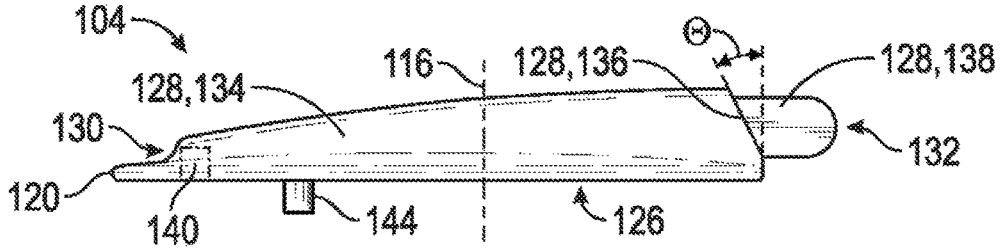
FIG. 13 displays a front elevation view of the control member of FIG. 12.
Figure 14:
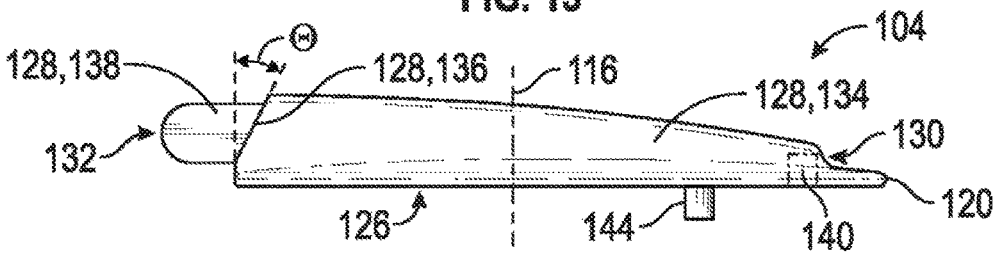
FIG. 14 displays a back elevation view of the control member of FIG. 12.
Figure 15:
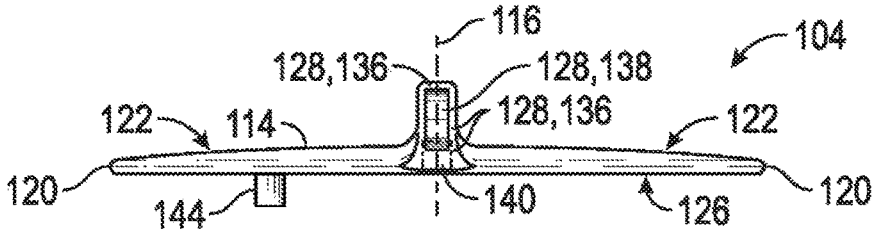
FIG. 15 displays a right side elevation view of the control member of FIG. 12.
Figure 16:
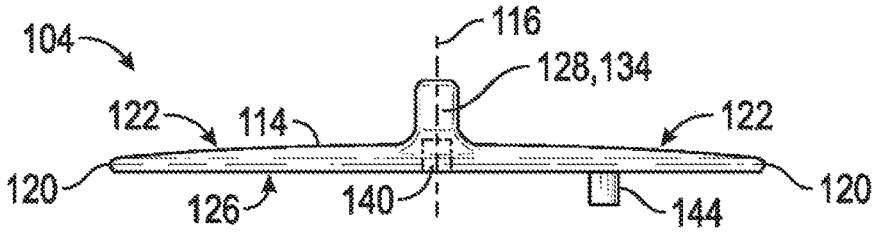
FIG. 16 displays a left side elevation view of the control member of FIG. 12.
Figure 17:
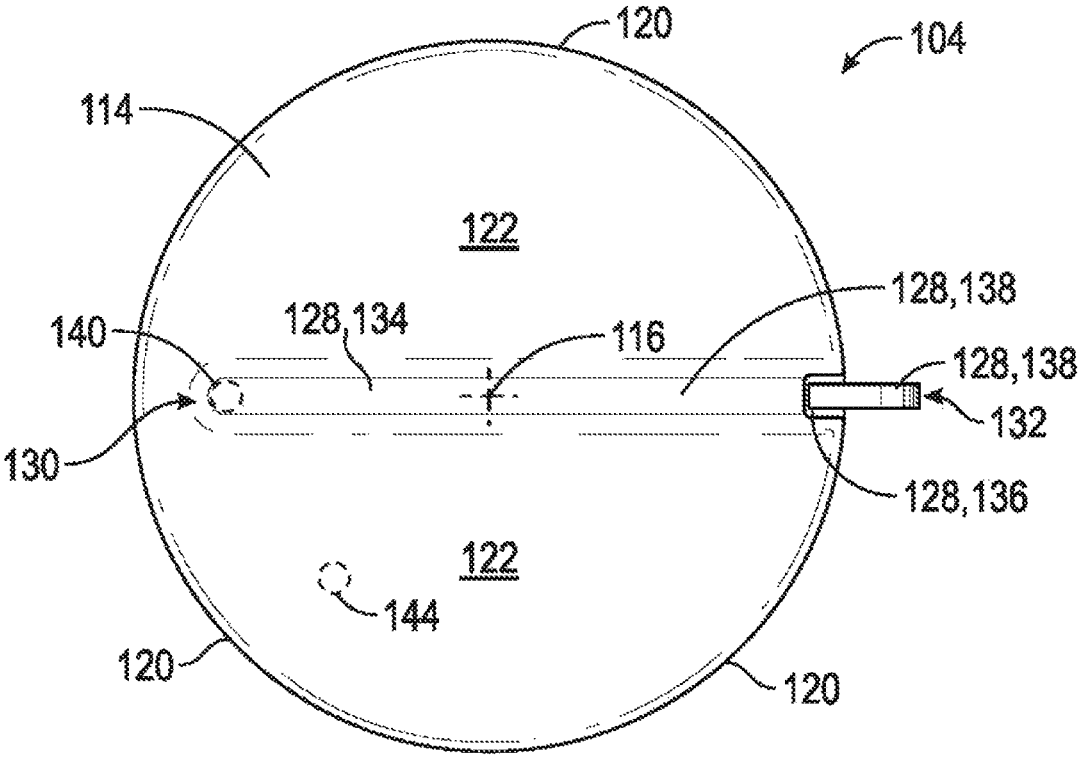
FIG. 17 displays a top plan view of the control member of FIG. 12.
Figure 18:
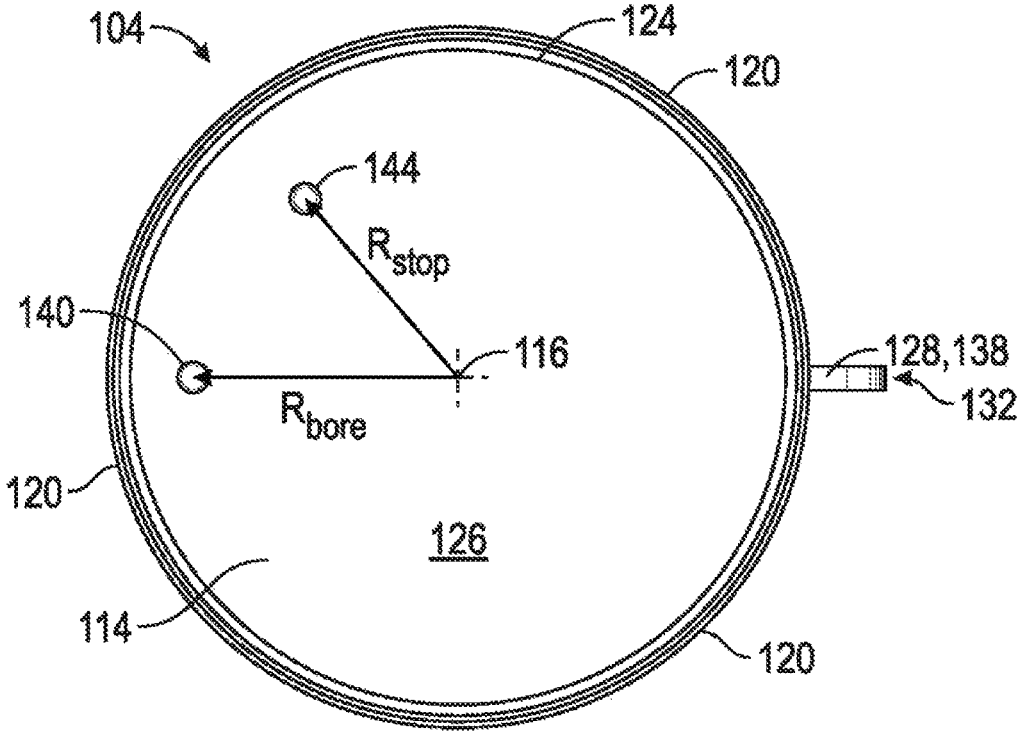
FIG. 18 displays a bottom plan view of the control member of FIG. 12.
Figure 19:
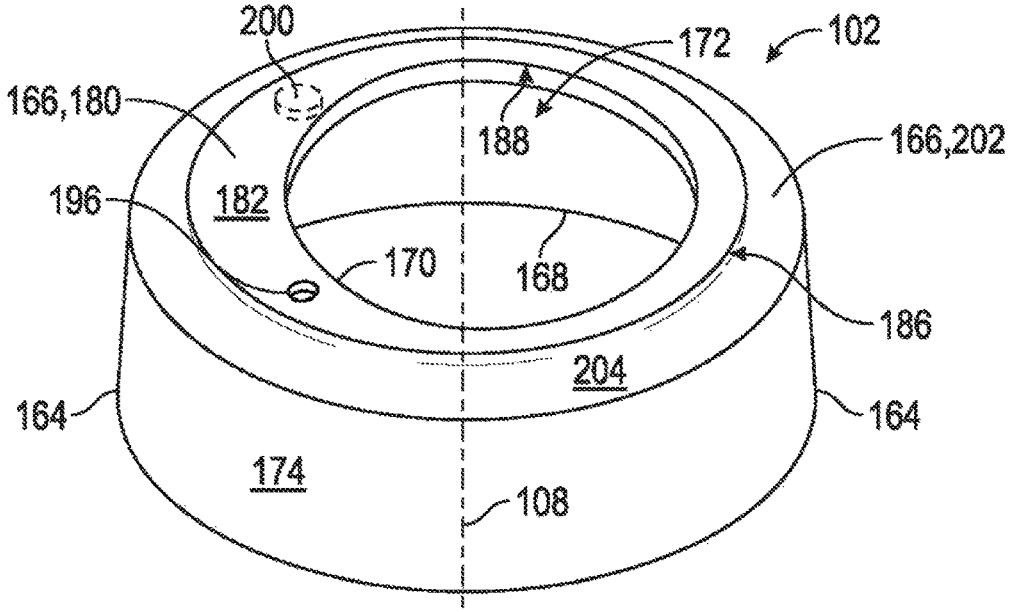
FIG. 19 displays a perspective view of a base member of the chimney vent cap of FIG. 1.
Figure 20:
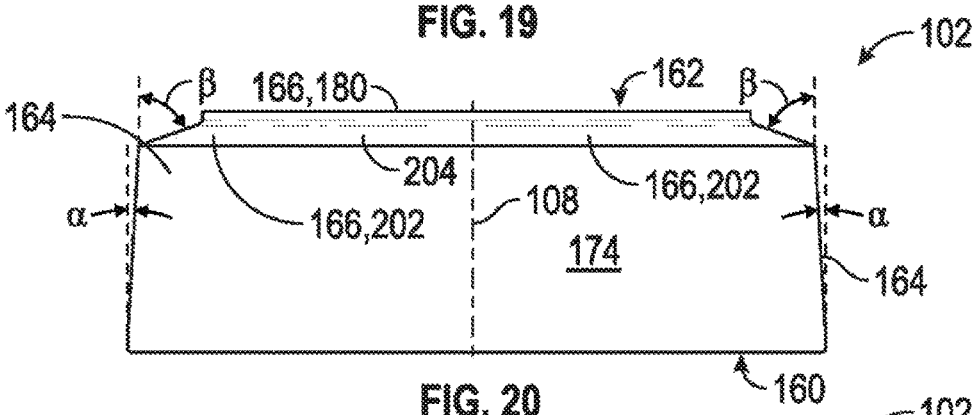
FIG. 20 displays a front elevation view of the base member of FIG. 19.
Figure 21:
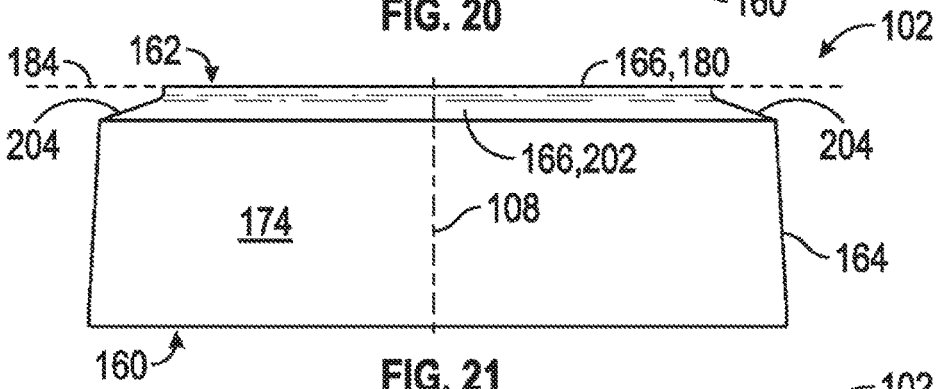
FIG. 21 displays a back elevation view of the base member of FIG. 19.
Figure 22:
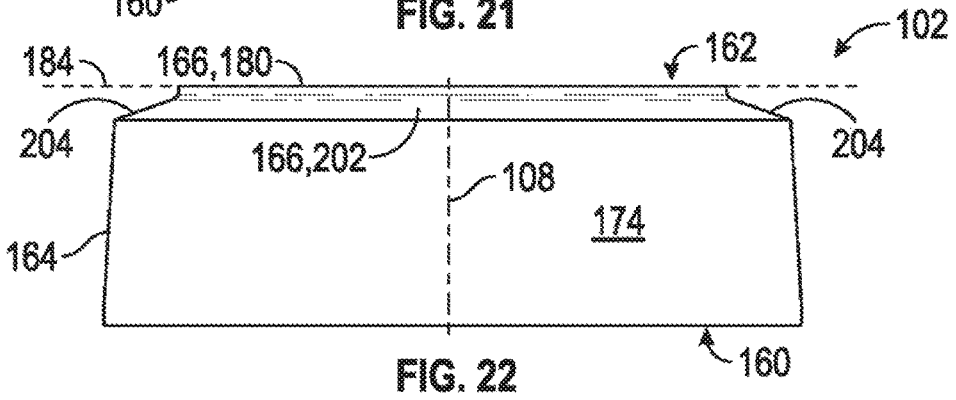
FIG. 22 displays a right side elevation view of the base member of FIG. 19.
Figure 23:
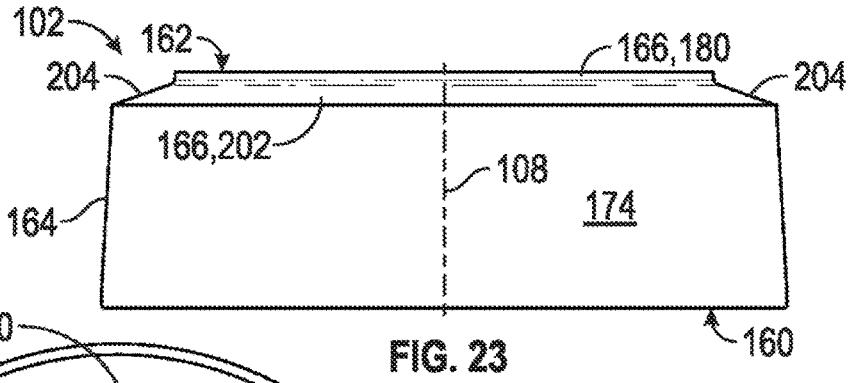
FIG. 23 displays a left side elevation view of the base member of FIG. 19.

The rib's first portion 134 has a generally triangular shape when viewed in the front and back views of FIGS. 13 and 14, has a generally rounded rectangular cross sectional shape at each longitudinal location between the rib's first end 130 and shoulder surface 136, and is contoured to rise from and blend with the disc portion's top surface 122 at each such longitudinal location while gradually increasing in height relative to the disc portion's top surface 122 from a minimum height at the rib's first end 130 to a maximum height near the shoulder surface 136. The rib's second portion 138 extends from the shoulder surface 136 to the rib's second end 132 with the cross section of the rib 128 abruptly changing at the shoulder surface 136 to a rectangular cross sectional shape at each longitudinal location between the shoulder surface 136 and the rib's second end 132 for which the cross sectional dimensions of the rib 128 are smaller in each direction than the similarly disposed cross sectional dimensions of the rib's first portion 134 at or near the shoulder surface 136. The cross sectional shape and dimensions of the rib's second portion 138 are selected for mating cooperation with the grip member's cavity 230 (described below) to enable the grip member 106 to be slid, during assembly, onto the rib's second portion 138 (and, correspondingly, for the rib's second portion 138 to be inserted into and received by and within the grip member's cavity 230) and into abutment with the rib's first portion 134 at the shoulder surface 136 as displayed in FIGS. 4-6, 9, and 11. The rib's second portion 138 has an arcuate shape near the rib's second end 132 as seen in the front and back views of FIGS. 13 and 14. The arcuate shape renders easier the initial installation of the grip member 106 onto and about the rib's second portion 138 (via insertion of the rib's second portion 138 into the grip member's cavity 230) during assembly of the chimney vent cap 100. The cross sectional shapes and dimensions of the rib's second portion 138 and grip member's cavity 230 are also selected such that a friction fit is created between the rib's second portion 138 and the grip member 106, thereby causing the grip member 106 to remain affixed to the rib's second portion 138.

The control member 104 defines a bore 140 that receives a fastener 142 at a location near the rib's first end 130 that pivotally secures the control member 104 to the base member 102 with the control member's bottom surface 126 in contact with and parallel to the base member's bearing surface 182 and plane 112. The fastener 142 is also received within a corresponding hole 196 defined in the base member 102 such that rotational axis 110 extends through bore 140, fastener 142 and hole 196 (see FIG. 10). The hole 192 is sized relative to the fastener 142 such that the fastener 142 does not rotate relative to the control member 104 during movement of the control member 104, but freely rotates within hole 196 and relative to base member 102 acting as a pivot pin to enable pivoting of the control member 104 relative to the base member 102. As a consequence, the control member 104 slidably rotates relative to the base member 102 about longitudinal axis 110 and with the control member's bottom surface 126 in contact with and parallel to the base member's bearing surface 182 and plane 112 when a force, "$F_1$" or "$F_2$", is applied to grip member 106 by a user in a direction generally tangential to the control member's disc portion 114 (see FIG. 9) and tending to rotate and re-position the control member 104 relative to the base member 102 into a different position corresponding to a different configuration of the chimney vent cap 100. According to the first example embodiment, the fastener 142 comprises a socket cap screw, but it should be understood and appreciated that the fastener 142 may comprise other forms or types of fasteners in other example embodiments.

Additionally, the control member 104 further comprises a stop 144 that depends from the control member's disc portion 114 at a location generally near the rib's first end 130 and bore 140, but angularly offset about central longitudinal axis 116 from bore 140 and with a radius, $R_{STOP}$, extending between stop 144 and central longitudinal axis 116 having a shorter measure than a radius, $R_{BORE}$, extending between bore 140 and central longitudinal axis 116. As seen in the bottom plan view of FIG. 18 and as described in more detail below, the base member 102 has a side wall 164 that defines a first opening 168 of the base member 102 for receiving at least a portion of a chimney of a cooking device therein. The base member 102 also has an end wall 166 with a slightly protruding support portion 180 that defines a second opening 170 of the base member 102 through which exhaust gases pass while exiting the chimney vent cap 100. The stop 144 protrudes into the second opening 170 of the base member 102 and limits rotational movement of the control member 104 relative to the base member 102 about rotational axis 110 and in both the clockwise and counterclockwise angular directions.

The base member 102, as briefly described above and shown in isolation in FIGS. 19-25, has a first end 160 and a distal second end 162 through which the base member's central longitudinal axis 108 extends. A side wall 164 of the base member 102 extends radially about and in the direction of the base member's central longitudinal axis 108 from the first end 160 toward an end wall 166 of the base member 102 at second end 162. The side wall 164 defines a first opening 168 of the base member 102 at the base member's first end 160 for receiving at least part of the chimney of a cooking device therethrough. The end wall 166 defines a second opening 170 of the base member 102 at the base member's second end 162 through which exhaust gases pass while exiting the chimney vent cap 100. Together, the side and end walls 164, 166 form a one piece, unitary structure and define a cavity 172 within the base member 102 such that the base member's first and second openings 168, 170 are in fluid communication via cavity 172, which extends between the first and second openings 168, 170. The side and end walls 164, 166 are configured such that the cavity 172 is sized to snugly receive at least part of the chimney of a cooking device therein with the chimney's side wall being substantially parallel to the base member's side wall 164, with the chimney's end abutting the inner surface of the base member's end wall 166 near the base member's second end 162, and preferably with the free end of the side wall 164 resting on the cooking device and about the cooking device's chimney at the base member's first end 160. According to the example embodiment, the side and end walls 164, 166 are manufactured from cast iron, but may be made, in other example embodiments, from other materials and/or using other manufacturing methods appropriate to provide a base member 102 having similar physical and mechanical characteristics. Also according to the example embodiment, the first opening 168 comprises a circular opening extending radially about central longitudinal axis 108.

Figure 25:
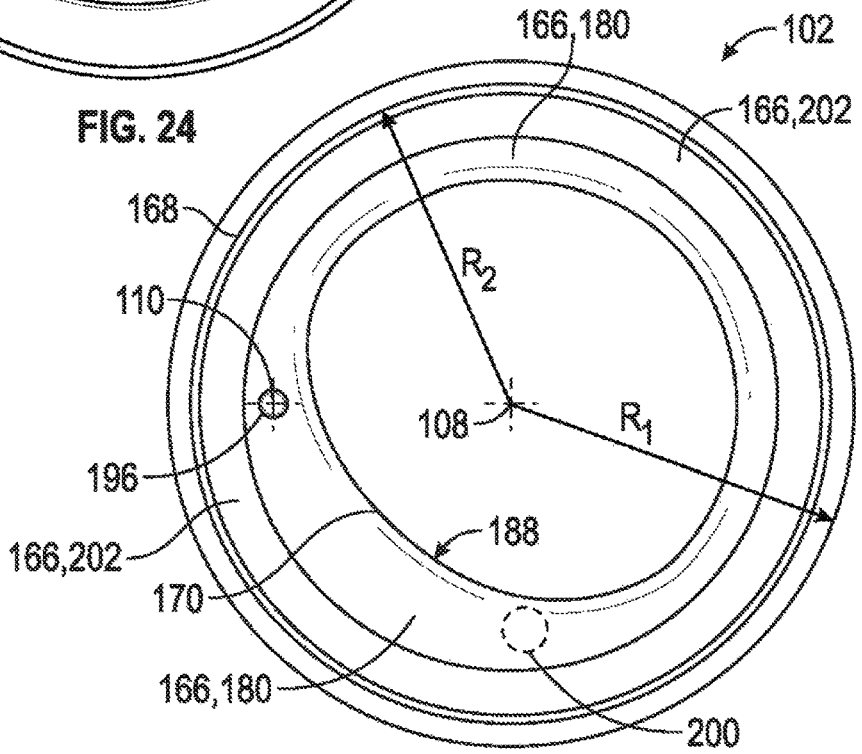
FIG. 25 displays a bottom plan view of the base member of FIG. 19.
Figure 26:
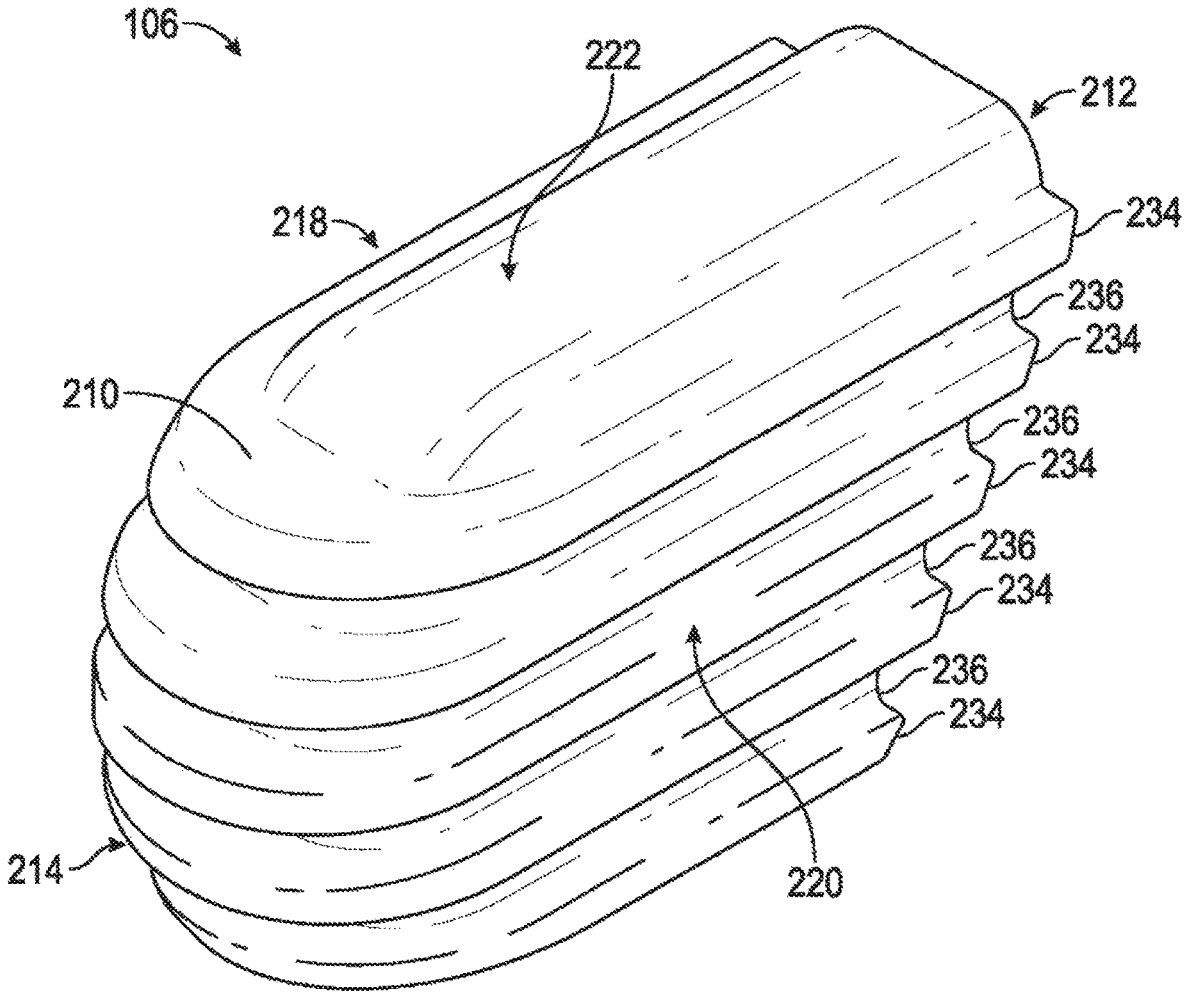
FIG. 26 displays a perspective view of a grip member of the chimney vent cap of FIG. 1.

The side wall 164 has an outside surface 174 and has outside radius, $R_1$, at the base member's first end 160 that is larger than the side wall's outside radius, $R_2$, at the location where the side wall 164 meets the end wall 166 (see FIG. 25). Consequentially, the side wall 164 defines an angle, $\alpha$, with the base member's central longitudinal axis 108. By virtue of the side wall 164 forming such angle, rain water or other liquid striking the side wall's outside surface 174 or running or dripping onto the side wall's outside surface 174 from other parts of the base member 102 is directed away from the base member's end wall 166 and away from the cooking device's chimney and any gap that might exist between the side wall 164 and such chimney at the base member's first end 160. By directing rain water and other liquids in this manner, the possibility of rain water and other liquids entering the cooking device's chimney is reduced substantially.

The base member's end wall 166 has a support portion 180 that supports the control member 104 in the various configurations of the chimney vent cap 100 and during movement of the control member 104 relative to the base member 102. The support portion 180 is formed as a boss that slightly protrudes in the direction of and about central longitudinal axis 108 and extends to the base member's second end 162. At the base member's second end 162, the support portion 180 defines the base member's second opening 170 and a bearing surface 182 that defines plane 184 substantially perpendicular to central longitudinal axis 108. The bearing surface 182 is in contact with the control member's bottom surface 126 and supports the control member 104 atop the base member 102 before, during, and after sliding rotational movement of the control member 104 relative to the base member 102.

Figure 24:
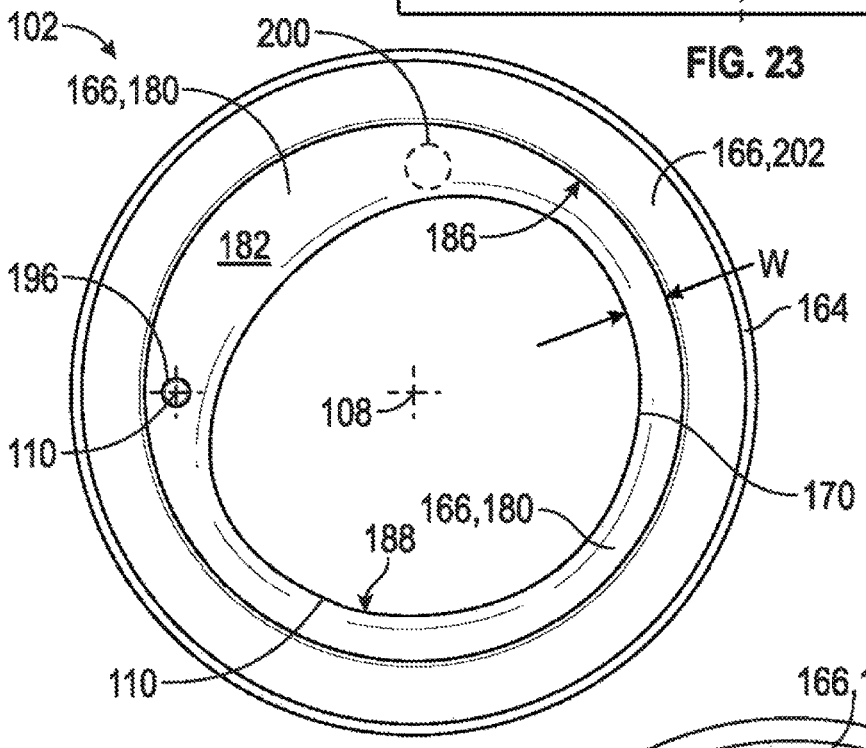
FIG. 24 displays a top plan view of the base member of FIG. 19.

The support portion 180 has a first edge 186 that extends radially about central longitudinal axis 108 and that defines the outer extents of the support portion 180 and the bearing surface 182. The support portion 180 also has a second edge 188 that defines the perimeter of the base member's second opening 170. Together, the edges 186, 188 define the inner and outer extents of the bearing surface 182 such that the bearing surface 182 extends between the first edge 186 and the second edge 188. As best seen in FIG. 24, the width, "w", of the bearing surface 182 measured in the radial direction about central longitudinal axis 108 between edges 186, 188 is different at various angular locations about central longitudinal axis 108. As a consequence, the base member's second opening 170 is not circular and is not centered or symmetrical about central longitudinal axis 108. However, the second opening 170 is sized and shaped to permit an appropriate flow of exhaust gases therethrough during use of the chimney vent cap 100 in its fully-open, second configuration that is sufficient to enable the cooking device with which the chimney vent cap 100 is in use to obtain a desired maximum internal temperature.

The base member 102, as briefly described above, defines a hole 196 that receives fastener 142 to pivotally couple the control member 104 and base member 102. More particularly, the support portion 180 of the base member's end wall 166 defines hole 196 with an opening in bearing surface 182 through which fastener 142 is inserted during assembly of the chimney vent cap 100. After such assembly, the hole 196 and fastener 142 are coaxially aligned with rotational axis 110. As illustrated more clearly in FIGS. 24 and 25, the hole 196 and rotational axis 110 are eccentrically located relative to the base member's central longitudinal axis 108 such that the control member 104 eccentrically rotates or pivots about rotational axis 110 and the bottom surface 126 of the control member's disc portion 114 moves parallel to planes 112, 184 and the base member's bearing surface 182.

Figure 35:
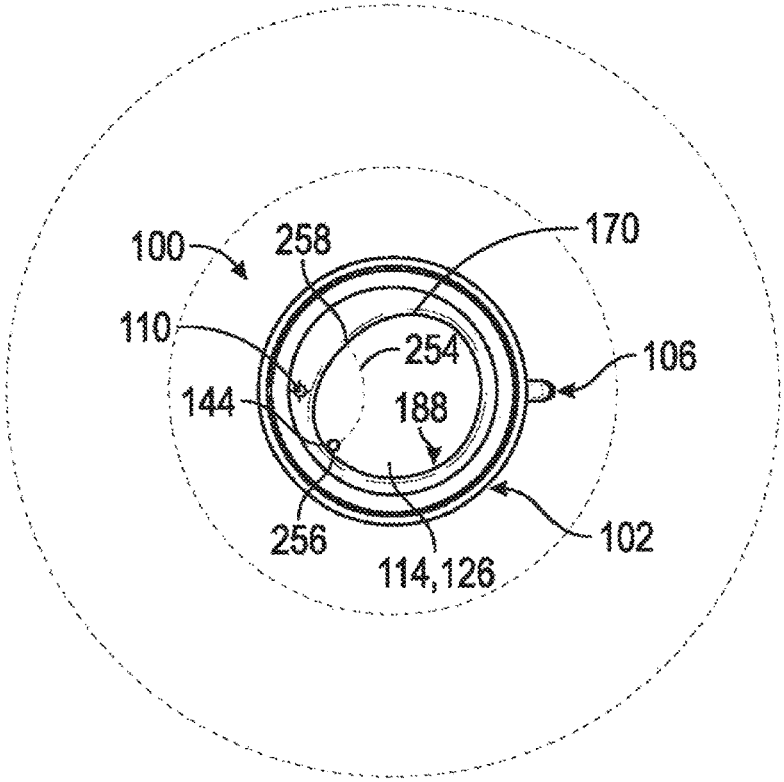
FIG. 35 displays a bottom plan view of the chimney vent cap of FIG. 33.
Figure 36:
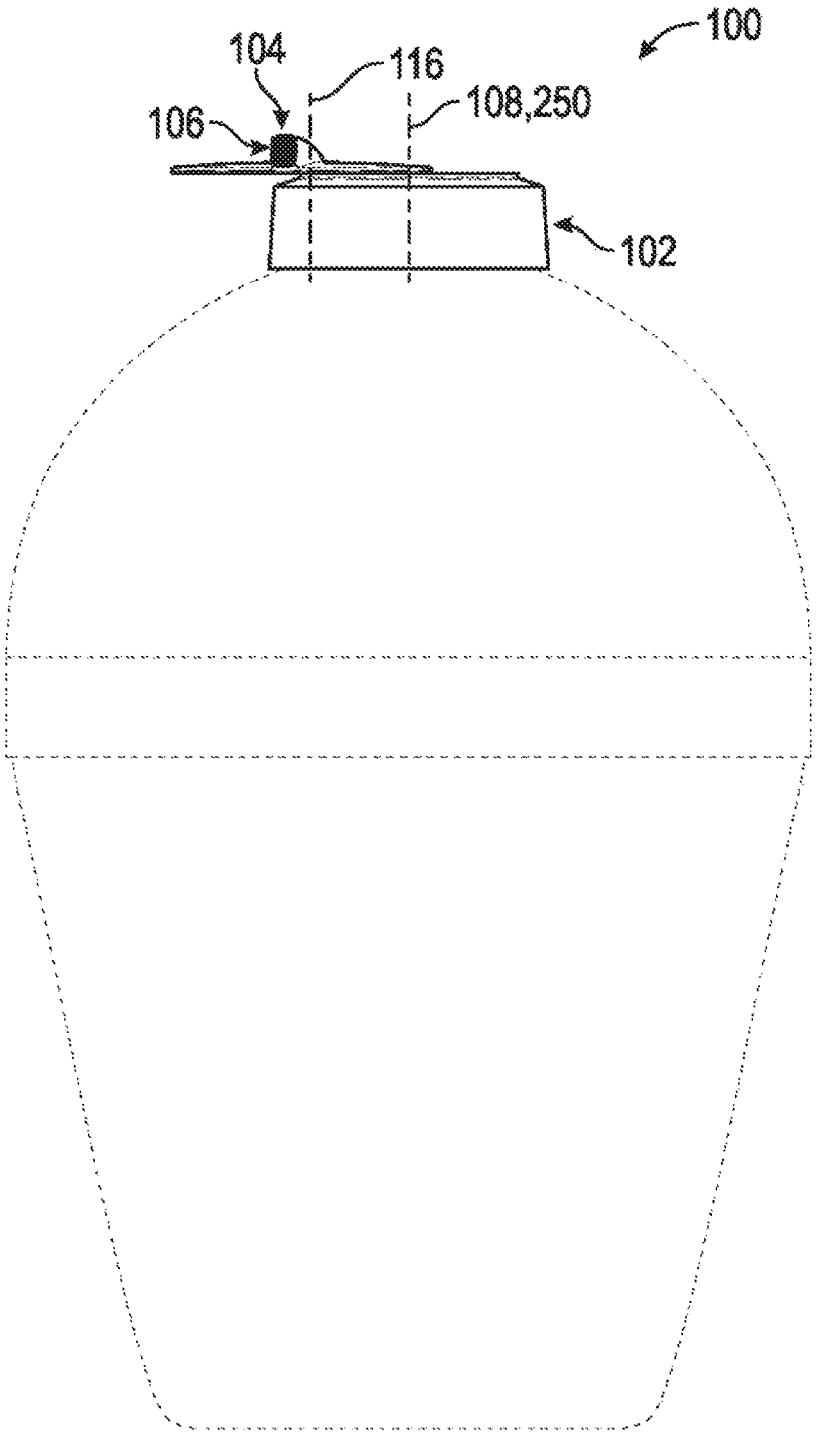
FIG. 36 displays a front elevation view of the chimney vent cap of FIG. 2 in use atop the cooking device and configured in the fully-open, second configuration.
Figure 37:
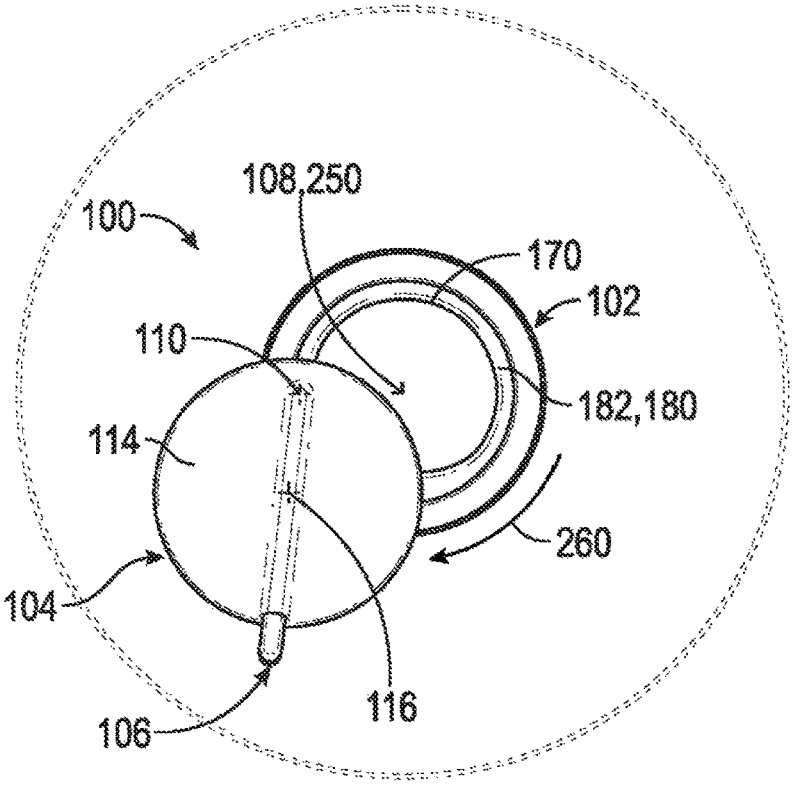
FIG. 37 displays a top plan view of the chimney vent cap of FIG. 36.
Figure 38:
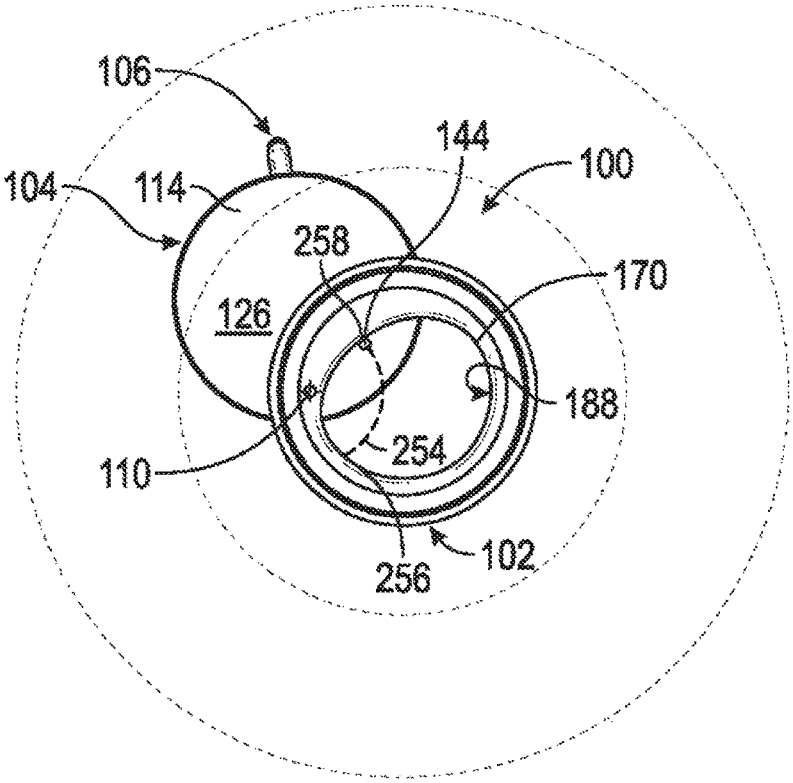
FIG. 38 displays a bottom plan view of the chimney vent cap of FIG. 36.

To maintain the relative positions of the base member 102 and control member 104 before, during and after rotation of the control member 104 relative to the base member 102 and in accordance with the first example embodiment, the base member 102 includes a magnet 200 exerting a sufficient magnetic force that is embedded in the support portion 180 of the base member's end wall 166. The magnet 200 is embedded beneath the base member's bearing surface 182 and within the support portion 180. The location for magnet 200 is selected, together with (a) the shape of the bearing surface 182 and second opening 170, (b) the relative location of hole 196, and (c) the relative location of stop 144 and the arc 254 traveled by the stop 144 (see FIGS. 35, 38 and 41), to provide an arrangement of the relative positions of the magnet 200, hole 196, and stop 144 such that at any time and regardless of the configuration of the chimney vent cap 100 and, hence, of the control member 104 relative to the base member 102, part of the control member's disc portion 114 is always located above the magnet 200 with the disc portion's lower surface 126 in close proximity to magnet 200. Because the magnetic force exerted by the magnet 200 tends to attract the control member's disc portion 114 and because part of the control member's disc portion 114 is always above the magnet 200 due to the arrangement and positions of the magnet 200, hole 196, stop 144, and arc 254, the base member 102 and control member 104 are maintained in their then current positions and configuration unless or until a force, "$F_1$" or "$F_2$", sufficient to temporarily overcome the magnetic force is applied to the grip member 106 causing rotation of the control member 104 about rotational axis 110 into a different configuration. Once in the different configuration, the magnetic force maintains the relative positions of the base and control members 102, 104 in such configuration, even during movement of the cooking device's chimney when a user opens or closes the cooking device's lid and, thereby, causes the flow of exhaust gases exiting the chimney vent cap 100 and the temperature within the cooking device to generally return to their states existing prior to opening of the cooking device's lid.

The base member's end wall 166 also has, as illustrated in FIGS. 19-25, a rain directing portion 202 extending between the base member's support portion 180 and side wall 164. The rain directing portion 202 has an outside surface 204 that defines an angle, β, relative to the base member's central longitudinal axis 108. Due to such angle, rain water and other liquids that drip onto the outside surface 204 from the control member 104 or that strike the outside surface 204 are directed away from the support portion 180 and toward the side wall 164. By directing rain water and other liquids away from the support portion 180, the rain directing portion 202 aids in substantially reducing the amount of rain water or other liquids that might enter the chimney vent cap 100 via the base member's second opening 170 and, hence, that might enter the chimney of the cooking device with which the chimney vent cap 100 is in use.

As briefly described above, the grip member 106 is connected to the control member 104 and is used by a user to configure the chimney vent cap 100 into a different configuration by rotating the control member 104 atop the base member 102 about rotational axis 110. The grip member 106, as seen in isolation and according to the first example embodiment in FIGS. 26-32, comprises a unitary structure adapted for secure grasping by a user's fingers. In order to minimize the risk of burns to the user's fingers, the grip member 106 is manufactured from a material that can withstand the temperatures reached by the cooking device with which the chimney vent cap 100 is used and that does not conduct heat well. According to the first example embodiment, the grip member 106 is manufactured from a silicone material. It should be understood and appreciated, however, that the grip member 106 may be manufactured from other materials in other example embodiments.

Figure 27:
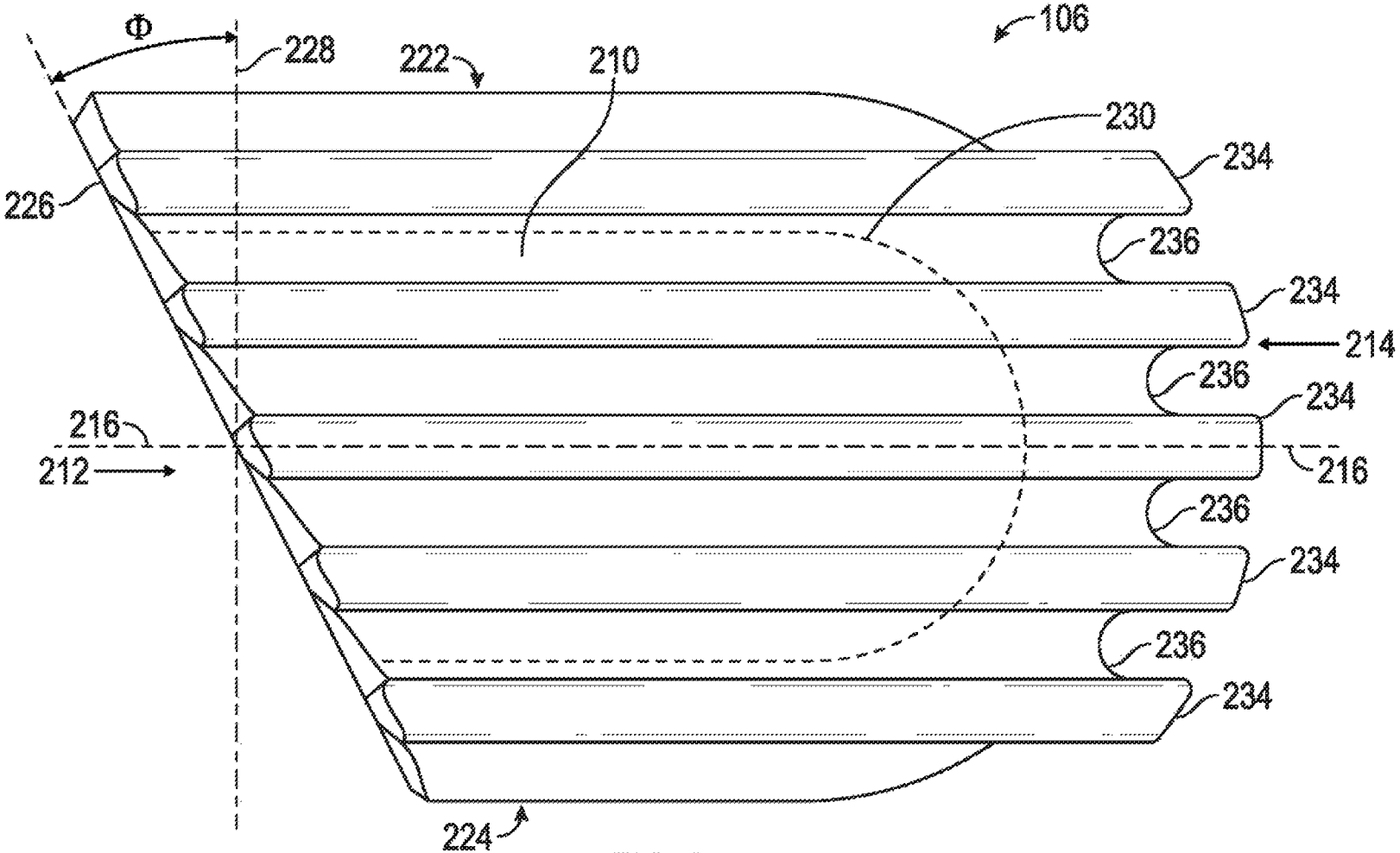
FIG. 27 displays a front elevation view of the grip member of FIG. 26.
Figure 28:
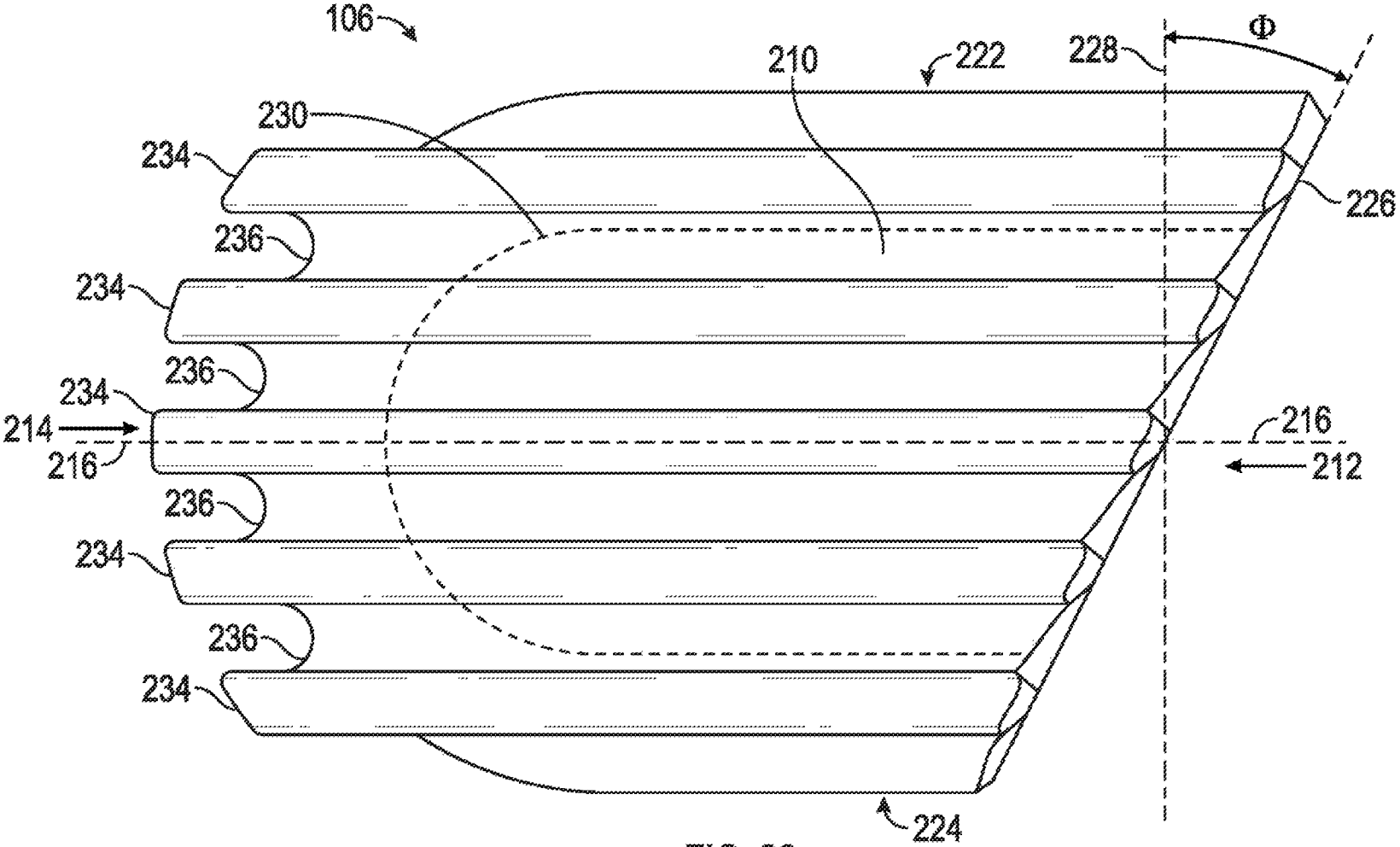
FIG. 28 displays a back elevation view of the grip member of FIG. 26.
Figure 30:
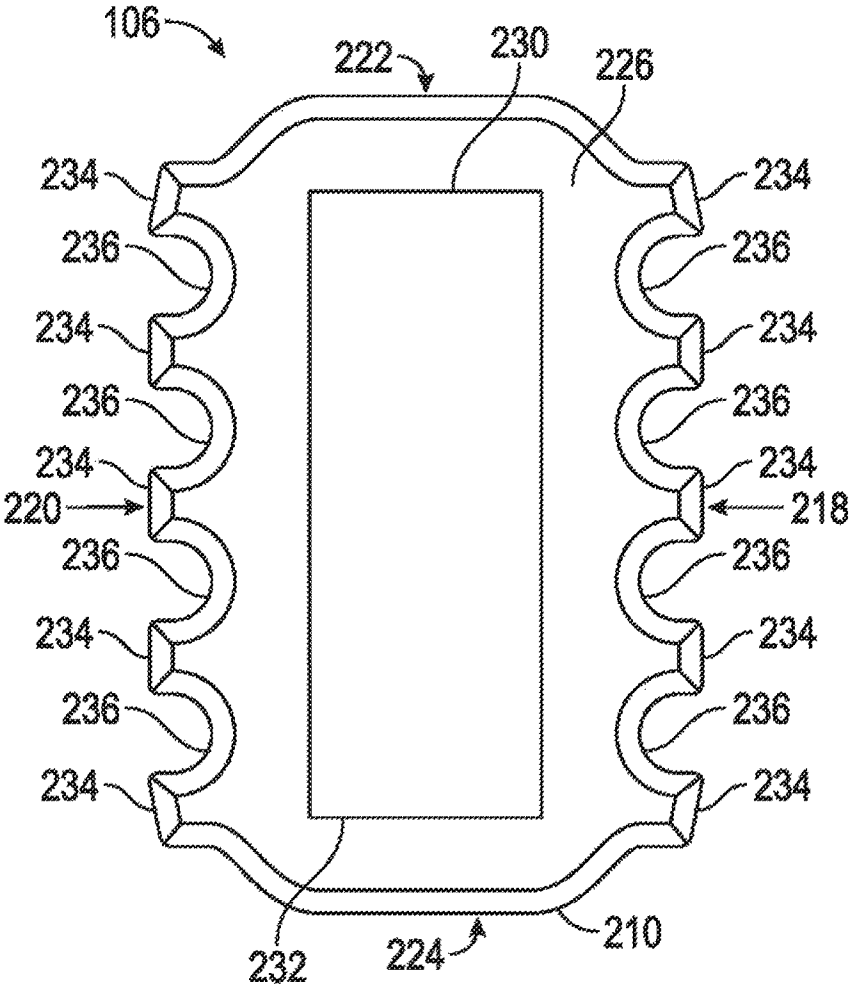
FIG. 30 displays a left side elevation view of the grip member of FIG. 26.
Figure 29:
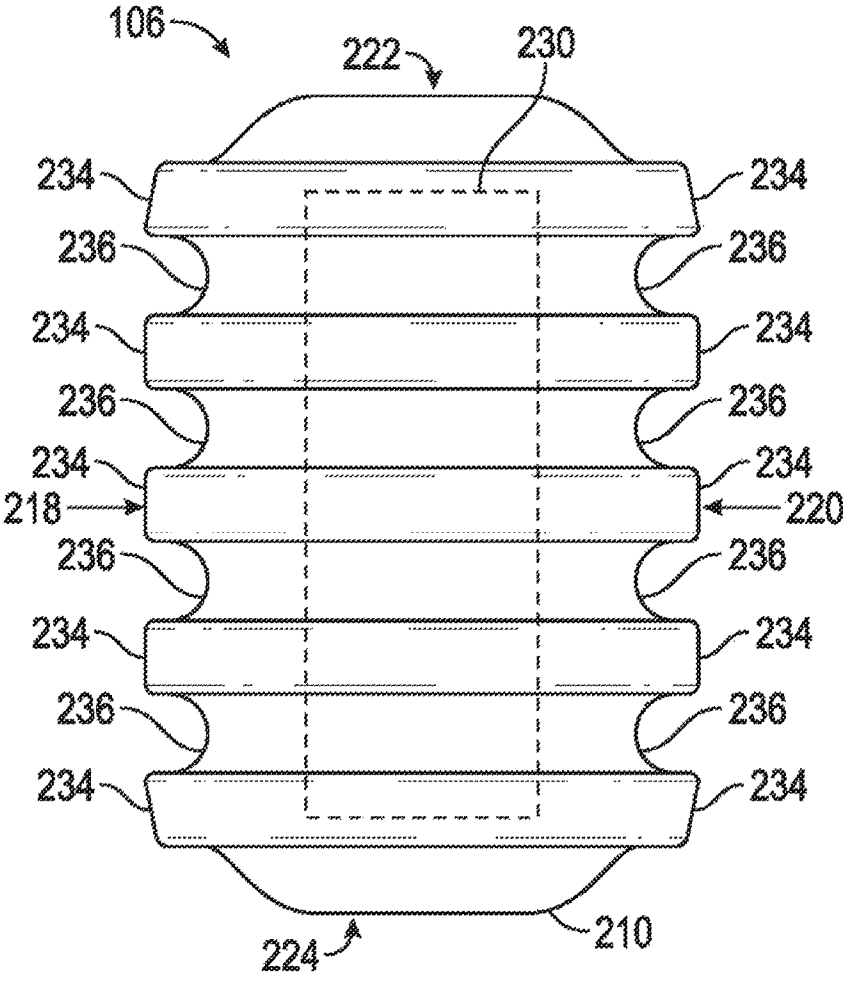
FIG. 29 displays a right side elevation view of the grip member of FIG. 26.
Figure 31:
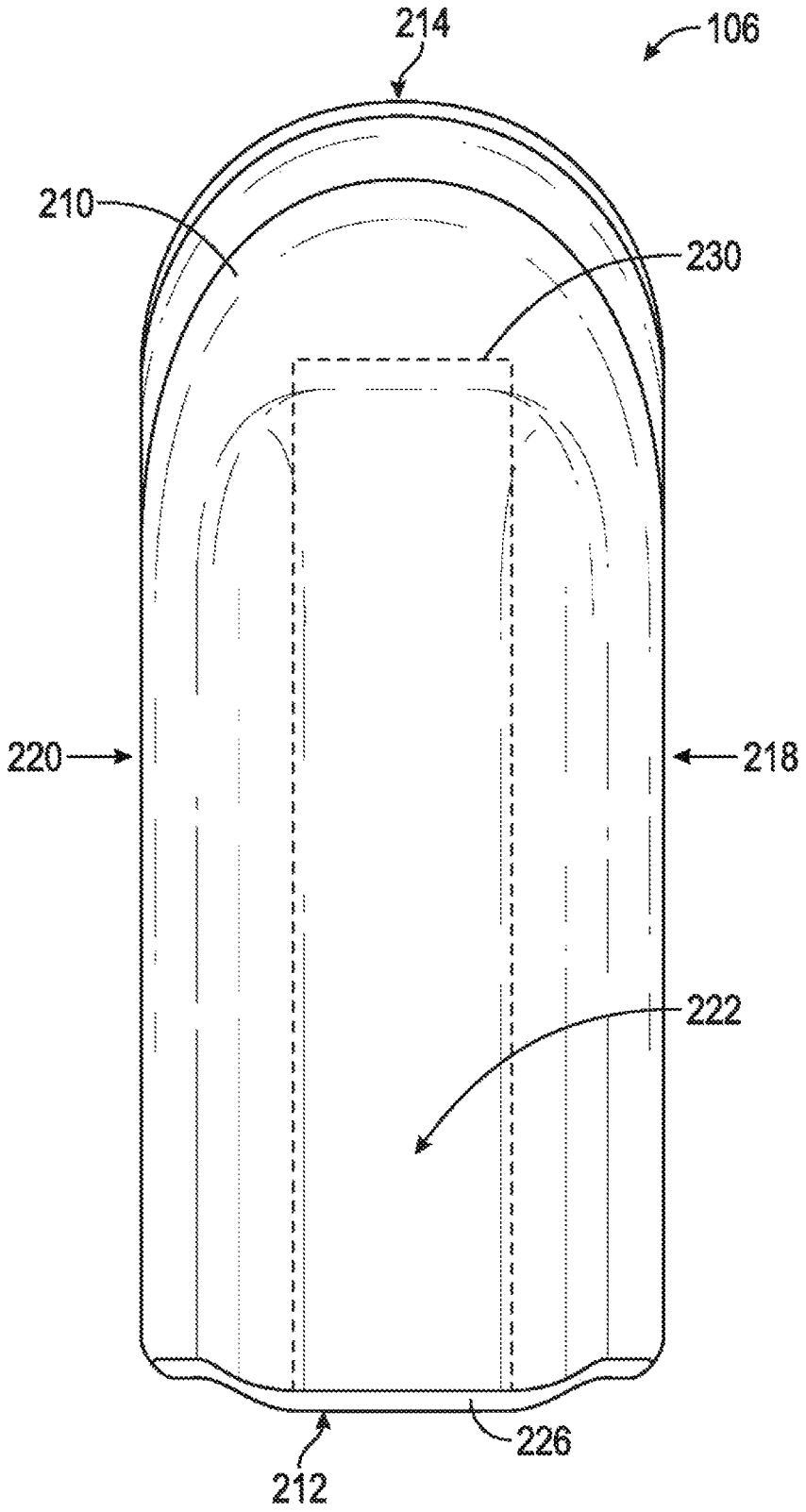
FIG. 31 displays a top plan view of the grip member of the grip member of FIG. 26.
Figure 32:
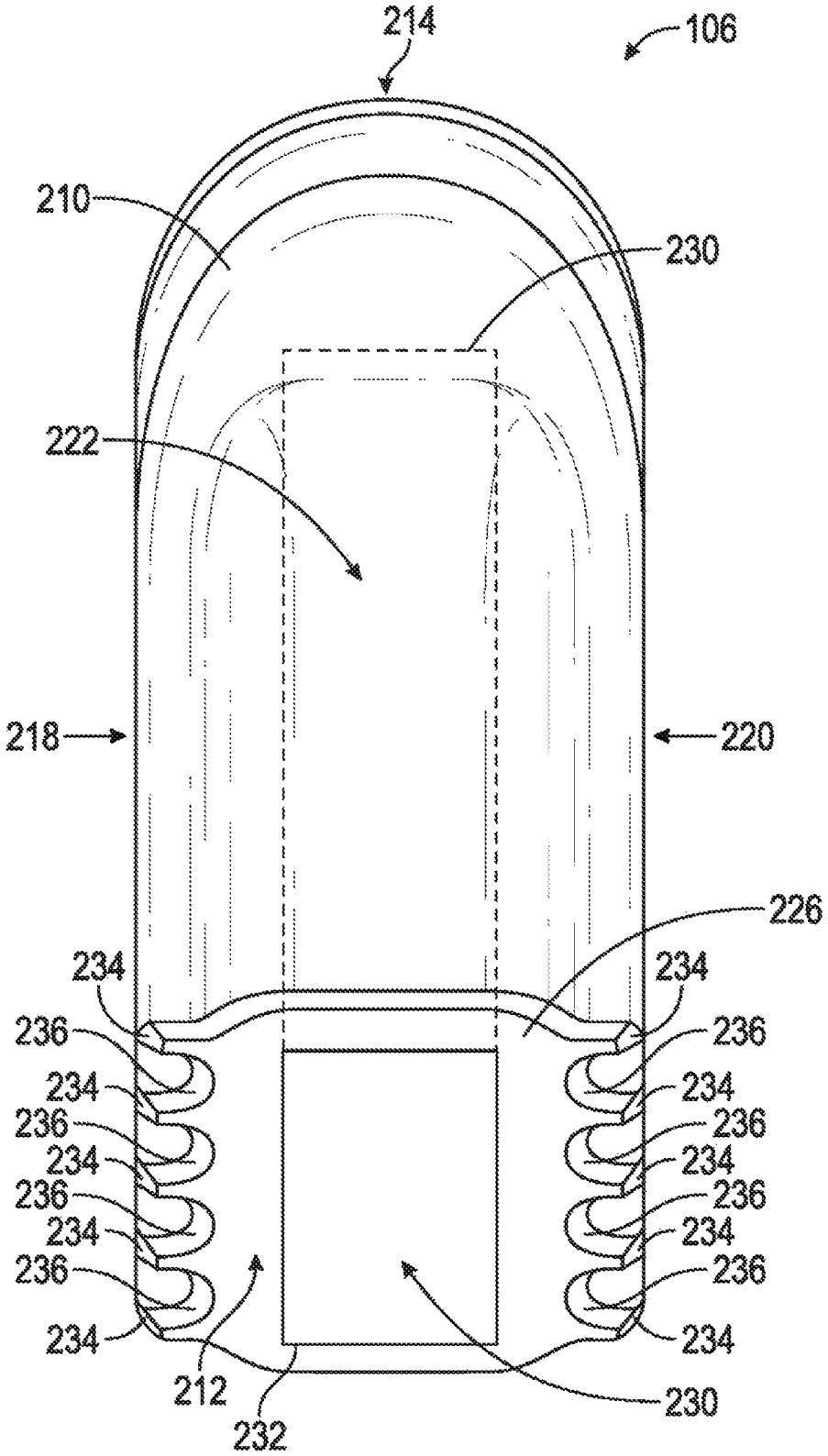
FIG. 32 displays a bottom plan view of the grip member of FIG. 26.
Figure 33:
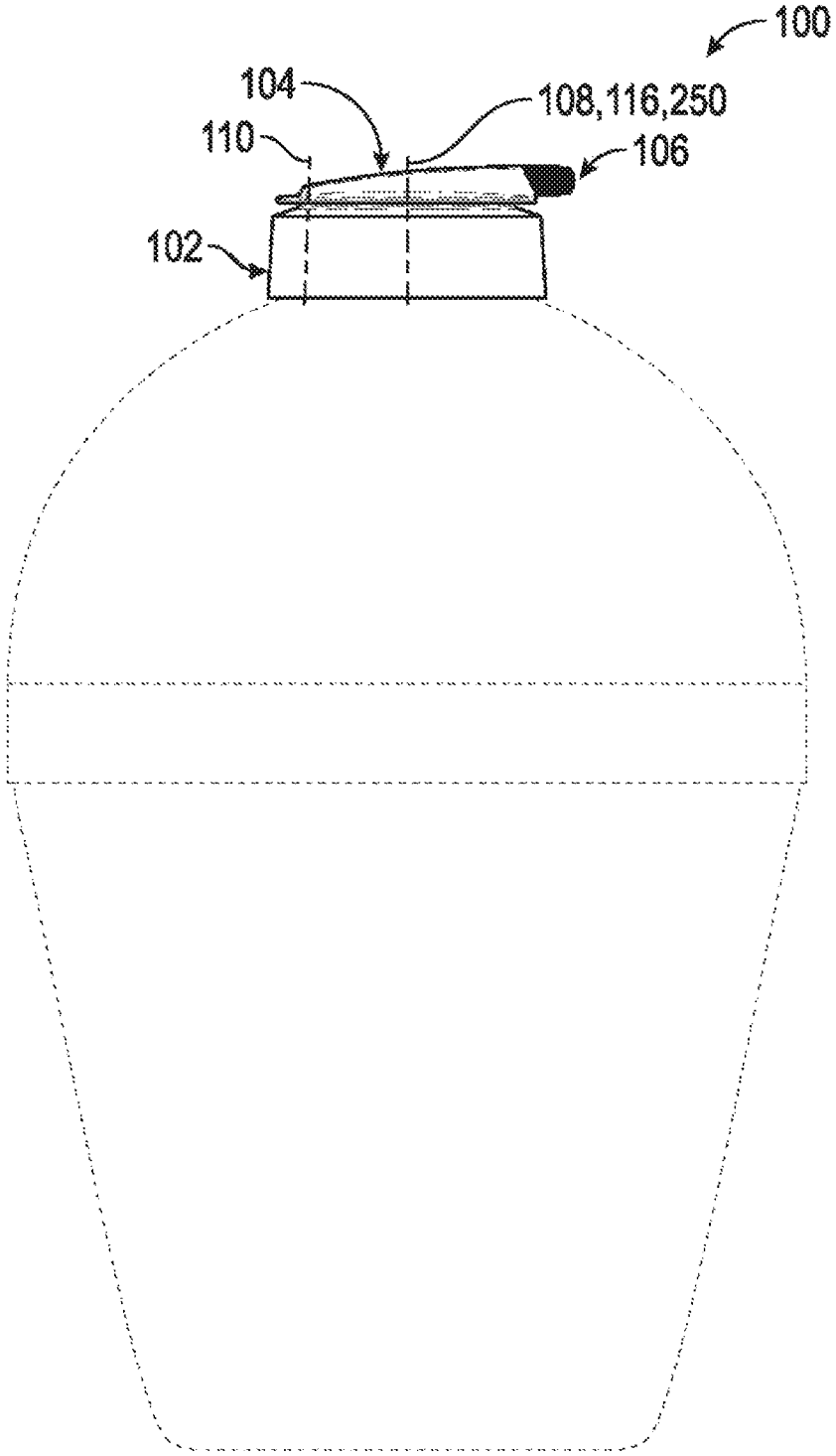
FIG. 33 displays a front elevation view of the chimney vent cap of FIG. 1 in use atop the cooking device and configured in the fully-closed, first configuration.

The grip member 106 is configured to allow a user to grasp and interact with the grip member 106 without slippage of the user's fingers. The grip member 106 comprises an elongate body 210 having a first end 212 and a second end 214 distal from the first end 212. A central longitudinal axis 216 extends between and through the first and second ends 212, 214. The elongate body 210 also has a front 218, back 220, top 222, and bottom 224. At the first end 212, the body 210 has a substantially planar, end surface 226 that defines an angle, φ, with a vertical axis 228 as seen in FIG. 27. The angular measure of angle, φ, is selected to have the same angular measure as angle, 0, defined by the shoulder surface 136 of rib 128 such that the grip member's end surface 226 abuts shoulder surface 136 absent any gap therebetween when the grip member 106 is connected to the control member 104 during assembly of the chimney vent cap 100.

The grip member's body 210 defines an elongate cavity 230 within the grip member 106 starting at the grip member's first end 212 and extending in the direction of central longitudinal axis 216 to a location substantially near grip member's second end 214. The grip member's body 210 also defines an opening 232 in the end surface 226 that is in fluid communication with the elongate cavity 230. The opening 232 and elongate cavity 230 are configured to cooperatively and snugly receive the second portion 138 and second end 132 of the control member's rib 128 therein. As such, the opening 232 and elongate cavity 230 generally have rectangular cross sections and are sized to receive the rib's second portion 138 and second end 132 without slippage between the body 210 and the rib's second portion 138 after the grip member 106 is fitted onto the rib's second portion 138.

Additionally, the grip member's body 210 has a plurality of ridges 234 and a plurality of troughs 236 extending from the grip member's first end 212, across the grip member's front 218, around the grip member's second end 214, and across the grip member's back 220. The ridges 234 and troughs 236 are arranged in an alternating arrangement with successive ridges 234 in the vertical direction having a trough 236 therebetween. When the grip member 106 is grasped by a user to apply a force, "$F_1$" or "$F_2$", to the grip member 106 tending to cause rotation of the control member 104 about rotational axis 110, the skin on the user's fingers tends to conform to the shape of the ridges 234 and troughs 236 with some of the skin at least partially filling in one or more of the troughs 236. By arranging the ridges 234 and troughs 236 in this manner and by virtue of such conformance of a user's skin to the shape of the ridges 234 and troughs 236, slippage between the users' grasping fingers and the grip member 106 is reduced significantly.

In use according to a method of operation and as illustrated in FIGS. 1-3 and 33-41 in connection with a Kamado-style cooking device (shown in dashed lines), the chimney vent cap 100 is mounted atop the cooking device's chimney after insertion of the chimney through the base member's first opening 168. In such position, the cavity 172 formed by the side and end walls 164, 166 of the base member 102 receives the chimney substantially therein with the chimney's side wall generally adjacent the base member's side wall 164 and the base member's first end 160 resting on the cooking device's lid, the chimney's end generally abutting the base member's end wall 166, and at least a portion of the chimney's upper opening generally adjacent to the base member's second opening 170. Also, the base member's central longitudinal axis 108 is collinear with the chimney's central longitudinal axis 250.

The chimney vent cap 100 is, typically, mounted atop the cooking device's chimney with the chimney vent cap 100 initially configured in the fully-closed, first configuration as displayed in FIGS. 1 and 33-35. The chimney vent cap 100 is configured by a user in the fully-closed, first configuration when the cooking device is not in use, thereby preventing rain water, other liquid, foreign bodies, or contaminants from entering the cooking device via its chimney. The chimney vent cap 100 is also configured by a user in the fully-closed configuration when the cooking device has been in use and the user desires to shut down (or at least temporarily slow) the combustion of fuel within the cooking device. This result occurs because, in the fully-closed, first configuration, the chimney vent cap 100 entirely blocks the flow of exhaust gases and prevents the entire flow of exhaust gases from passing through and exiting the chimney vent cap 100 into the surrounding environment, thereby creating maximal back pressure within the cooking device and substantially stopping the flow of fresh air into the cooking device for use in combustion.

More particularly, in the fully-closed, first configuration, the disc portion's central longitudinal axis 116 is coaxially aligned with the base member's central longitudinal axis 108 and, hence, with the central longitudinal axis 250 of the cooking device's chimney. Also, the bottom surface 126 of the control member's disc portion 114 rests atop and in contact with the entire bearing surface 182 of the base member's support portion 180 and fully occludes the base member's second opening 170 and prevents the flow of exhaust gases through the second opening 170 and plane 112. Additionally, the control member's stop 144 depends into the base member's second opening 170 and is engaged against the second edge 188 of the base member's support portion 180.

Figure 34:
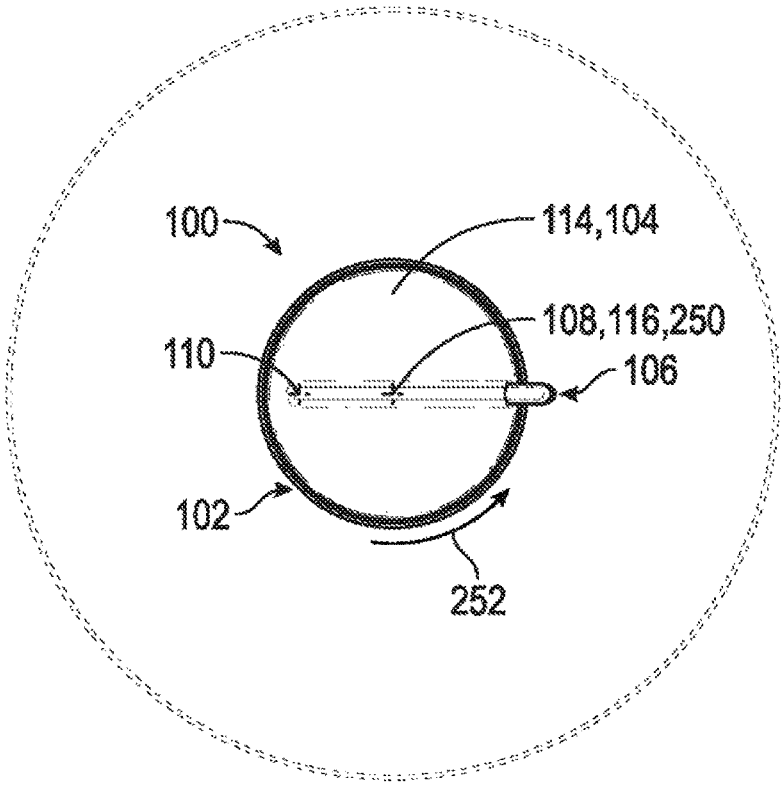
FIG. 34 displays a top plan view of the chimney vent cap of FIG. 33.

To configure the chimney vent cap 100 in the fully-closed, first configuration, the user grasps the grip member 106 and applies a force to the grip member 106 rotating the control member 104 about rotational axis 110 in the counterclockwise direction (indicated by arrow 252 in the top plan view of FIG. 34). During such rotation, the fastener 142 substantially prevents vertical movement of control member 104 relative to the base member 102 such that the bottom surface 126 of the control member 104 slides against and atop the bearing surface 182 of the base member's support portion 180 in a single plane. Also, the stop 144 travels along an arc 254 (shown in dashed lines in FIG. 35) about rotational axis 110 and toward the arc's first end 256. When the stop 144 engages the second edge 188 of the base member's support portion 180 at the first end 256 of the arc 254, the control member 104 cannot rotate further in the counterclockwise direction and the chimney vent cap 100 is in the fully-closed, first configuration.

According to the method of operation, the chimney vent cap 100 may be configured by a user in the fully-open, second configuration when the user desires to minimally block the flow of exhaust gases from the cooking device and chimney vent cap 100, and to allow a maximum flow of exhaust gases to pass through and exit the chimney vent cap 100 into the surrounding environment. When configured in the fully-open, second configuration, the chimney vent cap 100 minimally blocks the flow of exhaust gases and produces minimal backpressure within the cooking device, thereby maximizing the flow of fresh air into the cooking device for use in combustion. By maximizing the amount of fresh air available for combustion, fuel is oxidized at a faster rate with the result being that the temperature within the cooking device increases.

More specifically, in the fully-open, second configuration, the disc portion's central longitudinal axis 116 is parallel to (but not collinear with) the base member's central longitudinal axis 108 and, hence, parallel to (but not collinear with) the central longitudinal axis 250 of the cooking device's chimney. Also, the bottom surface 126 of the control member's disc portion 114 rests atop and in contact with a minimal portion of the bearing surface 182 of the base member's support portion 180 and minimally occludes the base member's second opening 170, allowing a maximum flow of exhaust gases through the second opening 170 and plane 112. Additionally, the control member's stop 144 depends into the base member's second opening 170 and is engaged against the second edge 188 of the base member's support portion 180.

To configure the chimney vent cap 100 in the fully-open, second configuration, the user grasps the grip member 106 and applies a force to the grip member 106 rotating the control member 104 about rotational axis 110 in the clockwise direction (indicated by arrow 260 in the top plan view of FIG. 37) until the control member 104 cannot be rotated further. During such rotation, the fastener 142 substantially prevents vertical movement of control member 104 relative to the base member 102 such that the bottom surface 126 of the control member 104 slides against and atop the bearing surface 182 of the base member's support portion 180 in a single plane. Also, the stop 144 travels along arc 254 (shown in dashed lines in FIG. 38) about rotational axis 110 and toward the arc's second end 258. When the stop 144 engages the second edge 188 of the base member's support portion 180 at the second end 258 of the arc 254, the control member 104 cannot rotate further in the clockwise direction and the chimney vent cap 100 is in the fully-open, second configuration.

Figure 39:
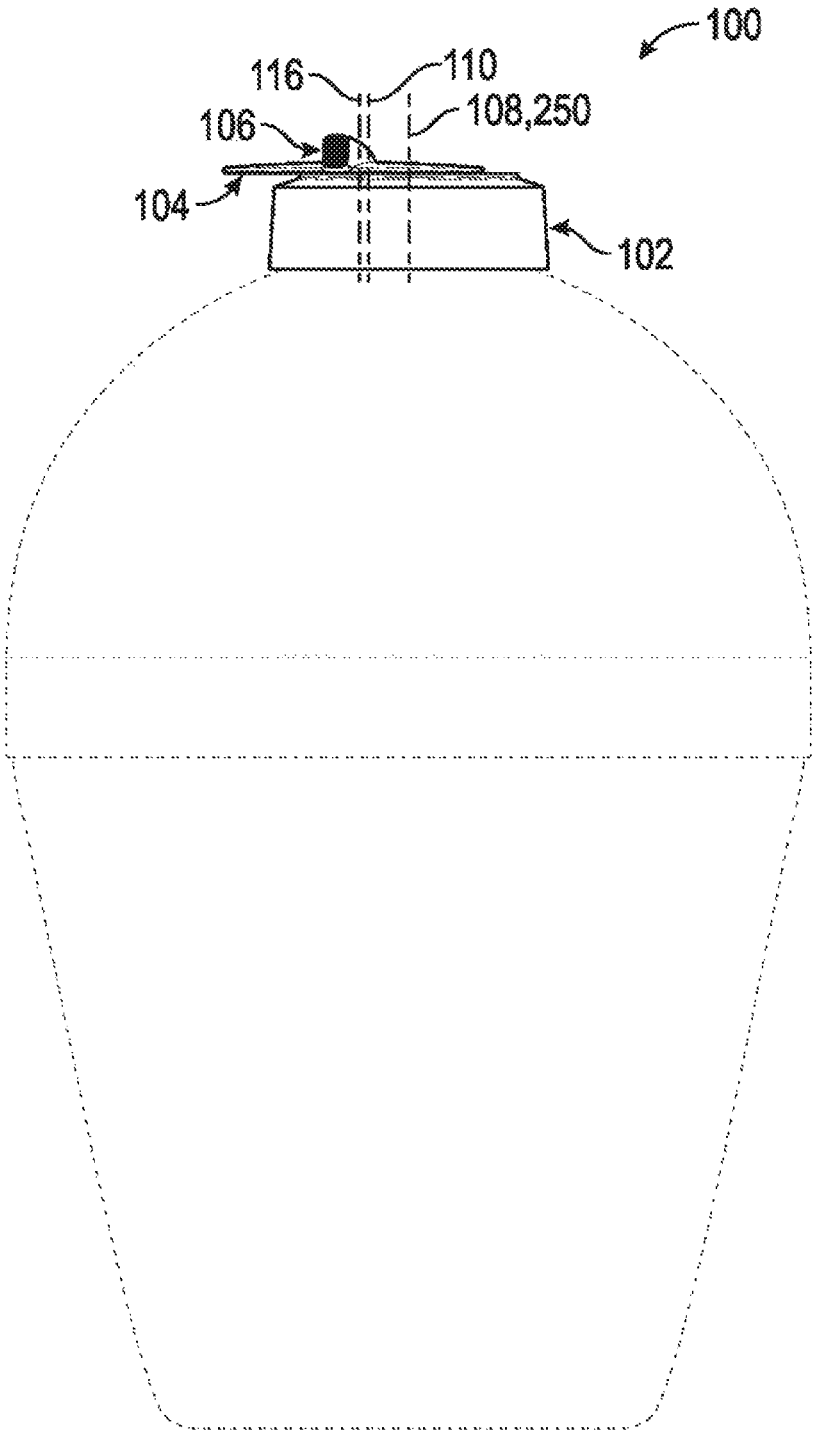
FIG. 39 displays a front elevation view of the chimney vent cap of FIG. 3 in use atop the cooking device and configured in the intermediate, partially-open, third configuration.
Figure 40:
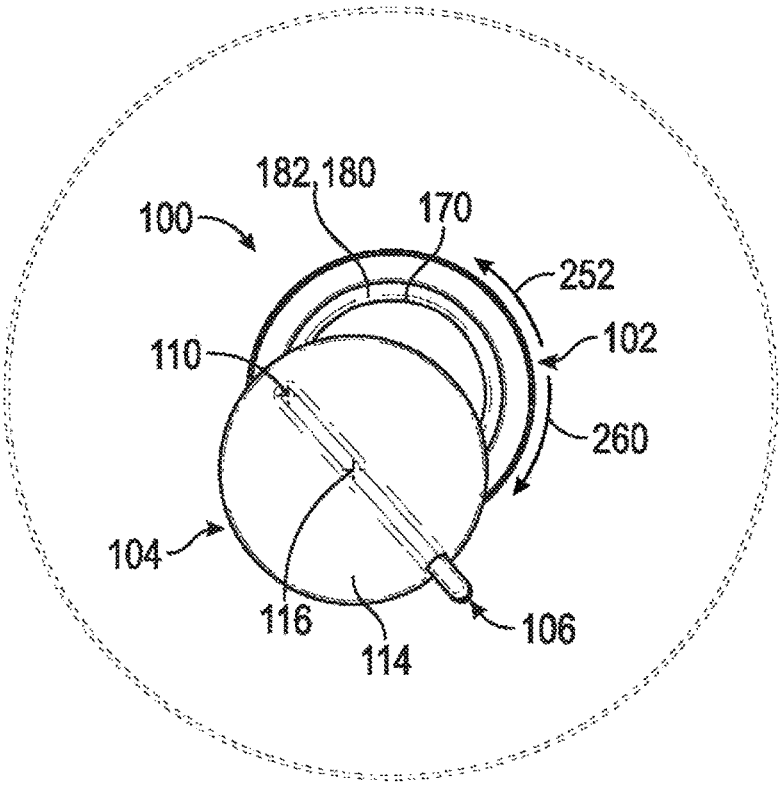
FIG. 40 displays a top plan view of the chimney vent cap of FIG. 36.
Figure 41:
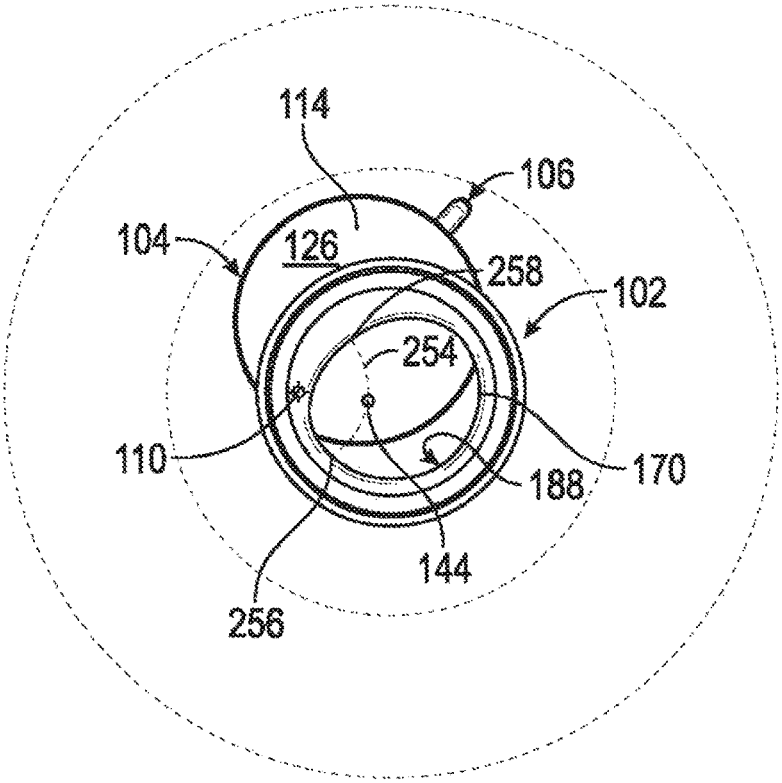
FIG. 41 displays a bottom plan view of the chimney vent cap of FIG. 36.

When a user desires to establish a temperature within the cooking device different than that in the fully-closed, first configuration or the fully-open, second configuration, the chimney vent cap 100 may be configured in an intermediate, partially-open, third configuration in which the control member 104 is positioned between its rotational position in the fully-closed, first configuration and its rotational position in the fully-open, second configuration. In FIGS. 39-41, the chimney vent cap 100 is configured in such an intermediate, partially-open, third configuration in accordance with the method of operation. In such configuration, the flow of exhaust gases from the cooking device and chimney vent cap 100 into the surrounding environment is between the minimum flow of the fully-closed, first configuration and maximum flow of the fully-open, second configuration. Also, the backpressure within the cooking device is also between the minimum backpressure of the fully-open, second configuration and the maximum backpressure of the fully-closed, first configuration, resulting in the flow of fresh air into the cooking device and available for combustion being between its minimum and maximum and the temperature within the cooking device being between its minimum and maximum.

More particularly, in an intermediate, partially-open, third configuration, the disc portion's central longitudinal axis 116 is parallel to (but not collinear with) the base member's central longitudinal axis 108 and, hence, parallel to (but not collinear with) the central longitudinal axis 250 of the cooking device's chimney. Also, the bottom surface 126 of the control member's disc portion 114 rests atop and in contact with a moderate portion of the bearing surface 182 of the base member's support portion 180 and partially occludes the base member's second opening 170, allowing an intermediate flow of exhaust gases through the second opening 170 and plane 112. Additionally, the control member's stop 144 depends into the base member's second opening 170, but is not engaged with the second edge 188 of the base member's support portion 180.

To configure the chimney vent cap 100 in an intermediate, partially-open, third configuration, the user grasps the grip member 106 and applies a force to the grip member 106 rotating the control member 104 about rotational axis 110 in either the counterclockwise or clockwise direction (indicated, respectively, by arrows 252, 260 in the top plan view of FIG. 40). During such rotation, the fastener 142 substantially prevents vertical movement of control member 104 relative to the base member 102 such that the bottom surface 126 of the control member 104 slides against and atop the bearing surface 182 of the base member's support portion 180 in a single plane. Also, the stop 144 travels along arc 254 (shown in dashed lines in FIG. 41) about rotational axis 110 between the arc's first and second ends 256, 258. When the chimney vent cap 100 has been configured in its desired intermediate, partially-open, third configuration with the control member 104 between its positions in the fully-closed, first configuration and the fully-open, second configuration, stop 144 resides at a corresponding intermediate location along arc 254 between the arc's first and second ends 256, 258.

It should be understood and appreciated that because the stop 144 engages the second edge 188 of the base member's support portion 180 at the arc's first and second ends 256, 258, the rotation of the stop 144 along arc 254 is limited by the base member's support portion 180 and, hence, the rotation of the control member 104 relative to the base member 102 is correspondingly limited to be between their positions in the fully-closed, first configuration and their positions in the fully-open, second configuration. Thus, the stop 144 serves to prevent excessive rotation of control member 104 relative to base member 102 about rotational axis 110 in either a clockwise or counterclockwise rotational direction.

It should also be understood and appreciated that, according to the method of operation and regardless of the then current configuration of the chimney vent cap 100 (and, hence, regardless of the rotational position of the control member 104 relative to the base member 102 about rotational axis 110), part of the control member's disc portion 114 is always kept elevationally above the magnet 200 embedded within the base member's support portion 180. By keeping part of the control member's disc portion 114 above the magnet 200, the relative rotational position of the base and control members 102, 104 is maintained until a force sufficient to overcome the magnet's attractive force is applied by a user to the grip member 106 to change the configuration of the chimney vent cap 100 from one configuration to another configuration.

In a second example embodiment, the chimney vent cap 100' is substantially similar to the chimney vent cap 100 of the first example embodiment with the exception that the base member 102' does not include a magnet to maintain the control member 104' in the same position relative to the base member 102' (and, hence, to maintain the chimney vent cap 100' in the same configuration) prior to, during, and after movement of the lid of the cooking device during opening or closing of the lid. Instead, the chimney vent cap 100' includes a washer and biasing member arranged about the shank of fastener 142' between the fastener's head and the bottom surface 126' of the control member 104'. More specifically, the washer is located between the fastener's head and the biasing member such that the biasing member contacts the washer and the bottom surface 126' of the control member 104'. The biasing member is operable to exert a force pulling the control member 104' toward the base member 102' about rotational axis 110' and is selected to allow a user to rotate the control member 104' relative to the base member 102' about rotational axis 110' during use, but yet to maintain the control member 104' in position relative to the base member 102' before, during, and after opening and closing of the lid of the cooking device with which the chimney vent cap 100' is used. According to the second example embodiment, the biasing member comprises a compression spring, but may comprise other devices having similar operation in other example embodiments.

According to a third example embodiment, the chimney vent cap 100" is substantially similar to the chimney vent cap 100 of the first example embodiment. However, in the third example embodiment, the chimney vent cap 100" includes no magnet, but one or both of the base member's bearing surface 182" and the control member's bottom surface 126" have a plurality of ridges, serrations, dimples, bumps, or other surface treatments or features, or combinations thereof, that are sized, spaced and oriented to substantially prevent the control member 104" from rotating about rotational axis 110" before, during, and after opening and closing of the lid of the cooking device unless a force is applied to the control member 104", via the grip member 106", by a user to cause such rotation.

In accordance with a fourth example embodiment, the chimney vent cap 100''' is substantially similar to the chimney vent cap 100 of the first example embodiment with the exception that the base member 102''' does not include a magnet, but one of the base member's bearing surface 182''' or control member's bottom surface 126''' has a protruding pin and the other of the base member's bearing surface 182''' or control member's bottom surface 126''' has a plurality of holes therein. The protruding pin and the plurality of holes are arranged relative to one another such that the protruding pin and the plurality of holes define a plurality of configurations of the control member 104''' relative to the base member 102". In each configuration, the control member 104''' is rotated in a different angular position about rotational axis 110''' and the protruding pin extends into a corresponding different hole of the plurality of holes. After a user imparts a force to the grip member 106''' causing rotation of the control member 104''' relative to the base member 102''' about rotational axis 110''', the control member 104''' and base member 102''' are arranged in a configuration in which the protruding pin extends into a different one of the plurality of holes than prior to such rotation. With the protruding pin residing in a hole, rotation of the control member 104''' relative to the base member 102''' is restricted, thereby allowing the lid of the cooking device to be opened or closed without movement of the control member 104''' relative to the base member 102'''.

According to a fifth example embodiment, the chimney vent cap 100"" is substantially similar to the chimney vent cap 100 of the first example embodiment. However, in the fifth example embodiment, the chimney vent cap 100"" includes no magnet and the bore 140"" extends through the disc portion 114"" and between the disc portion's top and bottom surfaces 122"", 126"". Also, the hole 192"" in the base member's end wall 166"" extends only partially into the base member 102"" and has an opening at the base member's second end 162"". The hole 192"" is threaded to receive a threaded pin therein. The threaded pin extends through bore 140"" and into hole 192"" such that the pin's threads are threadably engaged with the threads of hole 192"". The threaded pin has a head that contacts the disc portion's top surface 122"" when the threaded pin is fully threaded into hole 192"", thereby securing the control member 104"" in a particular configuration relative to the base member 102"". When the threaded pin is threaded partially out of hole 192"" by a user rotating the threaded pin, the control member 104"" may be rotated relative to the base member 102"" into a different configuration of the chimney vent cap 100"". After fully threading of the threaded pin back into hole 192"" by the user, the control member 104"" and base member 102"" are secured in such configuration and the lid of the cooking device may be opened and closed absent relative movement between the base member 102"" and control member 104"".

Whereas the present invention has been described in detail above with respect to example embodiments thereof, it should be appreciated that variations and modifications might be effected within the spirit and scope of the present invention.

What is claimed is:

1. A chimney vent cap for controlling flow of exhaust gases from a cooking device having a base and a lid movable relative to the base with the lid having a chimney through which the exhaust gases exit, the chimney vent cap comprising:

a base member adapted to receive at least a portion of the chimney of the cooking device within the base member at a first end, the base member defining an opening at a second end through which exhaust gases exiting the chimney pass;

a control member without holes adapted for selective movement relative to the base member into a configuration of the control member and the base member in which a portion of the opening in the base member is occluded by the control member, wherein the control member comprises a stop protruding from the control member into the opening of the base member, and wherein the stop engages an edge of a protruding support portion of an end wall of the base member, the edge of the protruding support portion defining the opening at the second end of the base member; and a retaining means adapted to retain the configuration of the control member and the base member in response to movement of the lid of the cooking device relative to the base of the cooking device during opening or closing of the lid when the cooking device is in use for cooking, wherein the retaining means is embedded in the base member and a portion of the control member is always over the retaining means.

2. The chimney vent cap of claim 1, wherein the retaining means adapted to retain the configuration of the control member and the base member comprises a magnetic force operative to retain the configuration of the control member and the base member.

3. The chimney vent cap of claim 2, wherein the retaining means adapted to retain the configuration of the control member and the base member comprises a magnet capable of exerting the magnetic force sufficient to retain the configuration of the control member and the base member.

4. The chimney vent cap of claim 1, wherein the control member and the base member are pivotally connected for rotation therebetween, and wherein the stop is adapted to limit angular rotation between the control member and the base member in a first angular direction.

5. The chimney vent cap of claim 4, wherein the stop comprises a first stop and the chimney vent cap further comprises a second stop adapted to limit angular rotation between the control member and the base member in a second angular direction.

6. The chimney vent cap of claim 1, wherein the chimney vent cap comprises a planar surface configured to at least partially occlude the opening defined by the base member.

7. The chimney vent cap of claim 1, wherein the chimney vent cap comprises a drip edge adapted to at least partially prevent liquid from entering the opening defined by the base member.

8. The chimney vent cap of claim 1, wherein the base member defines a central longitudinal axis, and wherein the control member and the base member are configured for relative rotation therebetween about a rotational axis offset from the central longitudinal axis.

9. The chimney vent cap of claim 1, wherein the opening defined by the base member has a non-circular periphery.

10. A chimney vent cap for controlling flow of exhaust gases from a cooking device having a base and a lid movable relative to the base with the lid having a chimney through which the exhaust gases exit, the chimney vent cap comprising:

a base member adapted to receive at least a portion of the chimney of the cooking device within the base member at a first end, the base member being adapted to receive exhaust gases flowing from the chimney in a predominant direction, the base member having an opening at a second end to permit exit of the exhaust gases;

a control member without holes adapted for selective movement by a user relative to the base member into a plurality of configurations of the control member and the base member to control the flow of exhaust gases from the base member through the opening by occluding the opening using the control member, wherein the control member comprises a stop protruding from the control member into the opening of the base member, and wherein the stop engages an edge of a protruding support portion of an end wall of the base member, the edge of the protruding support portion defining the opening at the second end of the base member;

wherein the control member and the base member are operable to control the flow of exhaust gases from the chimney without changing the predominant direction of travel of the exhaust gases and without insertion of the user's fingers into the exhaust gases; and a retaining means adapted to retain the respective configuration of the control member and the base member in response to movement of the lid of the cooking device relative to the base of the cooking device during opening or closing of the lid when the cooking device is in use for cooking, wherein the retaining means is embedded in the base member and a portion of the control member is always over the retaining means.

11. The chimney vent cap of claim 10, wherein the control member is movable relative to the opening of the base member in a direction substantially perpendicular to the predominant direction of travel of the exhaust gases.

12. The chimney vent cap of claim 10, wherein the control member comprises a surface movable in a plane substantially perpendicular to the predominant direction of travel of the exhaust gases.

13. The chimney vent cap of claim 10, wherein the chimney vent cap comprises a grip member extending from the control member and beyond the periphery of the base member regardless of the then current configuration of the control member and the base member, the grip member being adapted for grasping and movement by the user to move the control member relative to the base member and into a different configuration of the plurality of configurations absent insertion of the user's fingers into the exhaust gases.

14. The chimney vent cap of claim 13, wherein the base member and the control member are pivotally connected for relative rotation therebetween about a rotational axis, and wherein the grip member is rotatable about the rotational axis along a path always extending outside of the periphery of the base member.

15. The chimney vent cap of claim 10, wherein the chimney vent cap comprises a drip edge adapted to at least partially prevent liquid from entering the opening defined by the base member.

16. The chimney vent cap of claim 10, wherein the base member defines a central longitudinal axis, and wherein the control member and the base member are configured for relative rotation therebetween about a rotational axis offset from the central longitudinal axis.

17. The chimney vent cap of claim 10, wherein the opening defined by the base member has a non-circular periphery.

18. The chimney vent cap of claim 10, wherein the control member and the base member are pivotally connected for rotation therebetween, and wherein the stop is adapted to limit angular rotation between the control member and the base member in a first angular direction.

19. The chimney vent cap of claim 18, wherein the stop comprises a first stop and the chimney vent cap further comprises a second stop adapted to limit angular rotation between the control member and the base member in a second angular direction.

20. The chimney vent cap of claim 10, wherein the chimney vent cap comprises a planar surface configured to at least partially occlude the opening defined by the base member.

* * * * *